US009423119B2

(12) United States Patent
Schroll et al.

(10) Patent No.: US 9,423,119 B2
(45) Date of Patent: Aug. 23, 2016

(54) DEVICE FOR SECURING A SOURCE OF LED LIGHT TO A HEAT SINK SURFACE

(71) Applicant: IDEAL INDUSTRIES, INC., Sycamore, IL (US)

(72) Inventors: Matthew David Schroll, Glendale Heights, IL (US); Alan Emad Zantout, Sycamore, IL (US)

(73) Assignee: IDEAL INDUSTRIES, INC., Sycamore, IL (US)

( * ) Notice: Subject to any disclaimer, the term of this patent is extended or adjusted under 35 U.S.C. 154(b) by 149 days.

(21) Appl. No.: 14/206,769

(22) Filed: Mar. 12, 2014

(65) Prior Publication Data

US 2014/0268887 A1 Sep. 18, 2014

Related U.S. Application Data

(63) Continuation of application No. 13/750,094, filed on Jan. 25, 2013, and a continuation-in-part of application No. 13/245,466, filed on Sep. 26, 2011, now Pat. No. 8,807,793.

(60) Provisional application No. 61/591,518, filed on Jan. 27, 2012.

(51) Int. Cl.

| | |
|---|---|
| ***F21V 19/00*** | (2006.01) |
| ***F21V 29/507*** | (2015.01) |
| ***F21K 99/00*** | (2016.01) |
| ***F21V 15/01*** | (2006.01) |

(Continued)

(52) U.S. Cl.

CPC ..... *F21V 29/507* (2015.01); *F21K 9/30* (2013.01); *F21V 15/01* (2013.01); *F21V 19/004* (2013.01); *F21V 23/06* (2013.01); *F21V 29/70* (2015.01)

(58) Field of Classification Search

CPC ..... F21K 9/30; F21K 99/00; F21V 15/01; F21V 15/011; F21V 29/70; F21V 19/004; F21V 29/507; F21V 23/06; F21V 29/89; F21V 29/00; F21V 19/00; F21V 29/22; F21V 19/003; F21V 19/0055

See application file for complete search history.

(56) References Cited

U.S. PATENT DOCUMENTS

| | | | |
|---|---|---|---|
| 5,038,255 | A | 8/1991 | Nishihashi et al. |
| 5,143,331 | A | 9/1992 | Robert |

(Continued)

FOREIGN PATENT DOCUMENTS

| | | | |
|---|---|---|---|
| DE | 19818402 | A1 | 10/1999 |
| DE | 10319525 | A1 | 11/2004 |

(Continued)

OTHER PUBLICATIONS

ISA/US, International Search Report and Written Opinion issued on PCT Application No. US15/17472, date of mailing Jun. 3, 2015, 7 pages.

(Continued)

*Primary Examiner* — Y M. Lee
(74) *Attorney, Agent, or Firm* — Greenberg Traurig, LLP

(57) ABSTRACT

A device for securing a source of LED light to a heat sink includes an LED light source engaging surface that is arranged and configured to engage at least a portion of the source of LED light and which is provided with an integrated force applying spring. Further, the device may include a continuous metallic path extending between the sources of LED light and the surface.

8 Claims, 19 Drawing Sheets

(51) Int. Cl.
*F21V 23/06* (2006.01)
*F21V 29/70* (2015.01)

(56) References Cited

U.S. PATENT DOCUMENTS

| | | | |
|---|---|---|---|
| 5,283,716 | A | 2/1994 | Banitt et al. |
| 5,404,282 | A | 4/1995 | Klinke et al. |
| 5,660,461 | A | 8/1997 | Ignatius et al. |
| 6,318,886 | B1 | 11/2001 | Stopa et al. |
| 6,541,800 | B2 | 4/2003 | Barnett et al. |
| 6,582,100 | B1 | 6/2003 | Hochstein et al. |
| 6,667,544 | B1 | 12/2003 | Glenn |
| 6,817,735 | B2 | 11/2004 | Shimizu et al. |
| 6,911,731 | B2 | 6/2005 | Wu |
| 6,999,318 | B2 | 2/2006 | Newby |
| 7,306,353 | B2 | 12/2007 | Popovich et al. |
| 7,322,718 | B2 | 1/2008 | Setomoto et al. |
| 7,344,296 | B2 | 3/2008 | Matsui et al. |
| 7,348,604 | B2 | 3/2008 | Matheson |
| 7,400,029 | B2 | 7/2008 | Shimada et al. |
| 7,540,761 | B2 | 6/2009 | Weber et al. |
| 7,549,786 | B2 | 6/2009 | Higley et al. |
| 7,553,162 | B2 | 6/2009 | Isoda et al. |
| 7,952,114 | B2 | 5/2011 | Gingrich, III |
| 7,988,336 | B1 | 8/2011 | Harbers et al. |
| 8,226,276 | B2 | 7/2012 | Pachler et al. |
| 2002/0113244 | A1 | 8/2002 | Barnett et al. |
| 2002/0114155 | A1 | 8/2002 | Katogi et al. |
| 2002/0176250 | A1 | 11/2002 | Bohler et al. |
| 2003/0063463 | A1 | 4/2003 | Sloan et al. |
| 2003/0094893 | A1 | 5/2003 | Ellens et al. |
| 2003/0112627 | A1 | 6/2003 | Deese |
| 2003/0189829 | A1 | 10/2003 | Shimizu et al. |
| 2004/0066142 | A1 | 4/2004 | Stimac et al. |
| 2004/0175189 | A1 | 9/2004 | Weber-Rabsilber et al. |
| 2004/0252501 | A1 | 12/2004 | Moriyama et al. |
| 2004/0264195 | A1 | 12/2004 | Chang et al. |
| 2005/0152146 | A1 | 7/2005 | Owen et al. |
| 2005/0180157 | A1 | 8/2005 | Watanabe et al. |
| 2005/0226002 | A1 | 10/2005 | Aoki et al. |
| 2005/0243558 | A1 | 11/2005 | Van Duyn |
| 2006/0091410 | A1 | 5/2006 | Chen |
| 2006/0262533 | A1 | 11/2006 | Lin et al. |
| 2007/0025103 | A1 | 2/2007 | Chan |
| 2007/0246712 | A1 | 10/2007 | Kim et al. |
| 2008/0220631 | A1 | 9/2008 | Isoda et al. |
| 2008/0224166 | A1 | 9/2008 | Glovatsky et al. |
| 2008/0315214 | A1 | 12/2008 | Wall, Jr. et al. |
| 2009/0009103 | A1 | 1/2009 | McKechnie et al. |
| 2009/0009998 | A1 | 1/2009 | Malstrom et al. |
| 2009/0108281 | A1 | 4/2009 | Keller et al. |
| 2009/0130889 | A1 | 5/2009 | Daily et al. |
| 2009/0146919 | A1 | 6/2009 | Kline et al. |
| 2009/0191725 | A1 | 7/2009 | Vogt et al. |
| 2010/0046232 | A1 | 2/2010 | Matsui et al. |
| 2010/0277917 | A1 | 11/2010 | Shan |
| 2010/0314655 | A1 | 12/2010 | Thompson |
| 2010/0315813 | A1 | 12/2010 | Fugerer et al. |
| 2011/0019409 | A1 | 1/2011 | Wronski |
| 2011/0063842 | A1 | 3/2011 | Takei et al. |
| 2011/0090691 | A1* | 4/2011 | Markle et al. ..... F21K 9/00 362/249.02 |
| 2011/0136394 | A1 | 6/2011 | Mostoller et al. |
| 2011/0187258 | A1 | 8/2011 | Van Gennip et al. |
| 2011/0207372 | A1 | 8/2011 | Breen, IV |
| 2011/0210664 | A1* | 9/2011 | Hisayasu et al. ..... F21V 29/773 315/32 |
| 2011/0273895 | A1 | 11/2011 | Uemoto et al. |
| 2012/0156920 | A1* | 6/2012 | Sakai et al. ..... H01R 4/4818 439/387 |
| 2013/0044501 | A1 | 2/2013 | Rudisill et al. |
| 2013/0069103 | A1 | 3/2013 | Thompson |
| 2013/0121759 | A1 | 5/2013 | Breidenassel et al. |
| 2014/0029258 | A1 | 1/2014 | Schroll et al. |

FOREIGN PATENT DOCUMENTS

| | | | |
|---|---|---|---|
| EP | 1098135 | A2 | 5/2001 |
| JP | 2003-68129 | A | 3/2003 |
| JP | 2010097926 | A | 4/2010 |
| WO | 01/73844 | | 10/2001 |
| WO | 2007/128070 | A1 | 11/2007 |
| WO | 2009/150590 | A1 | 12/2009 |

OTHER PUBLICATIONS

European Patent Office, extended European Search Report issued on European patent application No. 13740819.1, dated Jul. 31, 2015, 12 pages.
ISA/US, International Search Report and Written Opinion of PCT Application No. US2013/23148, dated Mar. 22, 2013, 10 pages.
ISA/US, International Search Report and Written Opinion issued on PCT Application No. US15/17468, dated Jun. 8, 2015, 8 pages.
USPTO, Office Action issued on U.S. Appl. No. 13/750,094, dated Mar. 13, 2015, 14 pages.

* cited by examiner

DEVICE FOR SECURING A SOURCE OF LED LIGHT TO A HEAT SINK SURFACE

CROSS REFERENCE TO RELATED APPLICATION

This application is a continuation application of U.S. Non-provisional application Ser. No. 13/750,094, which is a non-provisional application claiming priority from U.S. Provisional Application Ser. No. 61/591,518, filed Jan. 27, 2012, and is a continuation-in-part of U.S. Non-provisional application Ser. No. 13/245,466, filed Sep. 26, 2011, each of which are incorporated herein by reference in their entireties.

FIELD OF THE DISCLOSURE

The present description relates generally to the mounting of a light emitting diode (LED) light source, and more particularly, to a device for securing a source of LED light to a heat sink surface.

BACKGROUND OF RELATED ART

Plastic devices which rely solely upon screw torque to secure a source of LED light, e.g., a LED light engine or a LED light module, to a surface of a heat sink are known in the art. Such known plastic devices, however, fail to provide a suitable force upon the source or LED light or provide for an even engagement between the source of LED light and the surface of the heat sink, whether when initially used or over time due to degradation of the plastic material.

DETAILED DESCRIPTION

Figure 2:
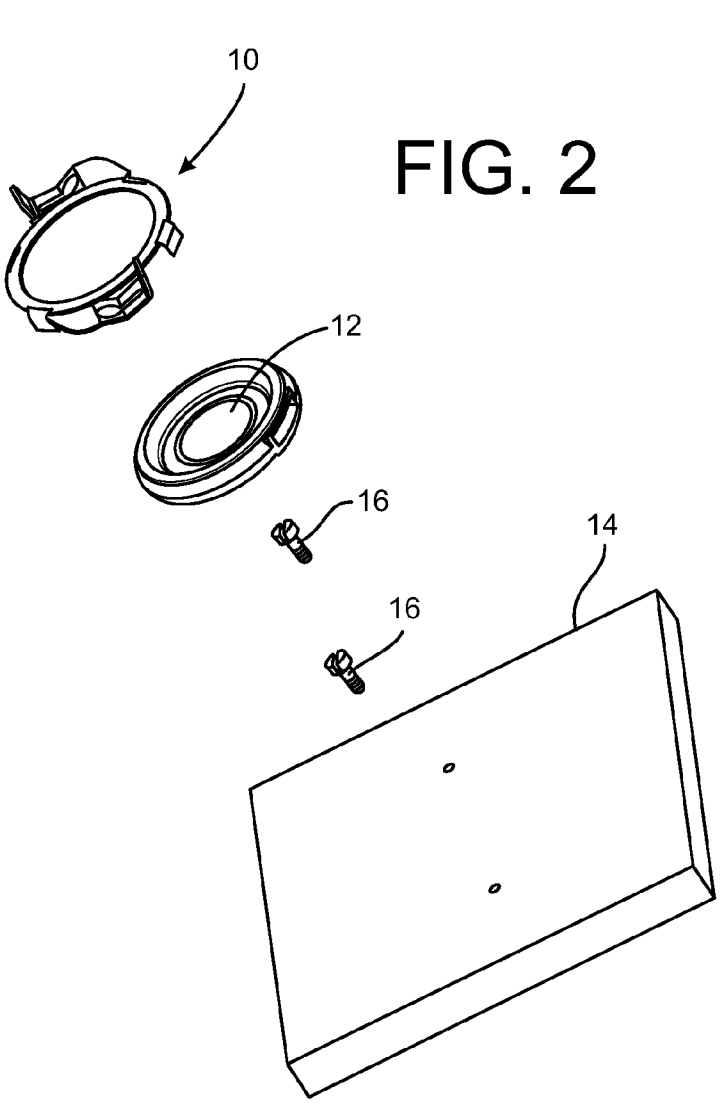
FIG. 2 illustrates an exploded view of the assembly of FIG. 1.

The following description of example methods and apparatus is not intended to limit the scope of the description to the precise form or forms detailed herein. Instead the following description is intended to be illustrative so that others may follow its teachings.

Described hereinafter are improved devices for securing a source of LED light to a mounting surface such as a heat sink surface. More particularly, the subject devices include a LED light source engaging surface that is arranged to engage a least a portion of a source of LED light wherein a force applying spring is integrated into the LED light engaging surface. The integrated force applying spring functions to generally, uniformly push the source of LED light against the surface of the heat sink thereby eliminating the screw torque concerns of the prior art devices. Similarly, the metallic nature of the device eliminates the thermal degradation concerns of the prior art devices. Thus, when the subject devices are attached to the heat sink, the devices will "sandwich" the source of LED light between the device and the heat sink 14 with the device flexing in the manner of a leaf spring so as to apply a force upon the source of LED light in a direction towards the heat sink with the result being a better thermal coupling between the source of LED light and the heat sink as compared to that provided by the prior art devices. By way of non-limiting example, the force applying leaf spring can be integrated into the LED light engaging surface, can be provided by providing the LED light engaging surface with one or more leaf-spring like mounting tabs, by providing the LED light engaging surface with a curved arrangement, etc.

While the foregoing provides a general description of the subject devices for securing a source of LED light to a heat sink and some advantages thereof, a better understanding of the objects, advantages, features, properties, and relationships of the subject devices will be obtained from the following detailed description and accompanying drawings which set forth illustrative examples and which are indicative of the various ways in which the principles of the invention may be employed.

Turning now to the figures, wherein like elements are referred to by like identifiers, illustrated are various examples of devices 10 that are usable to secure a source of LED light 12 to a mounting surface, such as a surface of a heat sink 14. As will become apparent from the description that follows, the subject devices 10 have, among others, the advantage of providing for a more even engagement between the source of LED light 12 and the surface of the heat sink 14. More particularly, the subject devices 10 are arranged and constructed to provide upon the source of LED light 12 forces that are distributed over at least a substantial portion of the source of LED light 12 which forces function to drive the source of LED light 12 onto the surface of the heat sink 14 in a more even manner as compared to prior art devices. Furthermore, the subject device 10 are preferably constructed from a material, such as a metal, whereby the force applying characteristics of the devices 10 will not substantially degrade over time, temperature (e.g., thermal cycling), and usage. Thus in some examples, the device 10 may have a monolithic metal construction.

Figure 1:
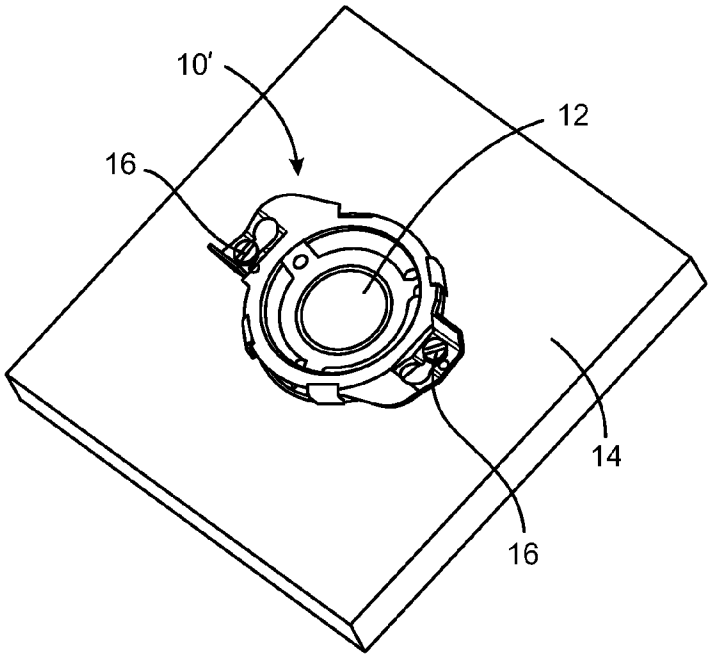
FIG. 1 illustrates an exemplary device being used to secure a source of LED light to a surface of a heat sink.
Figure 3:
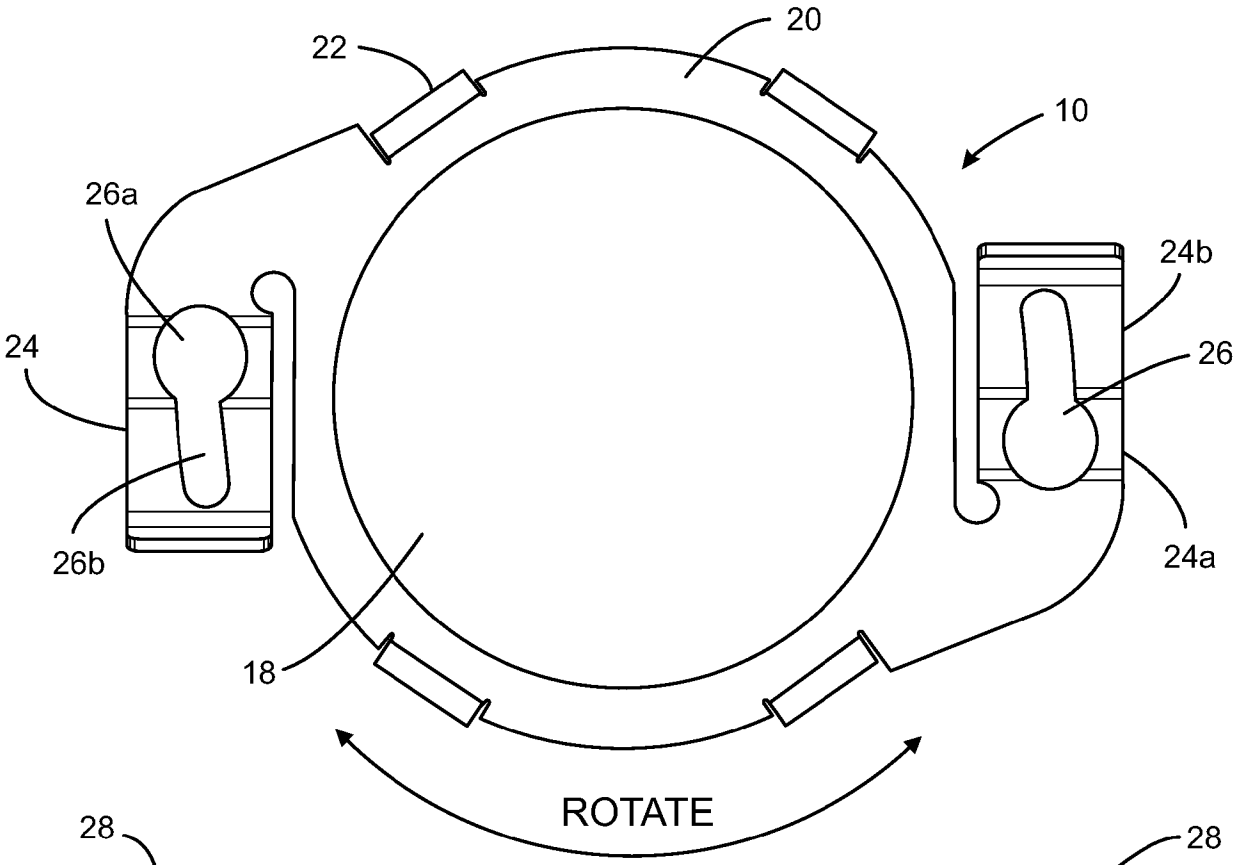
FIG. 3 is a top view of the exemplary device of FIG. 1.
Figure 4:
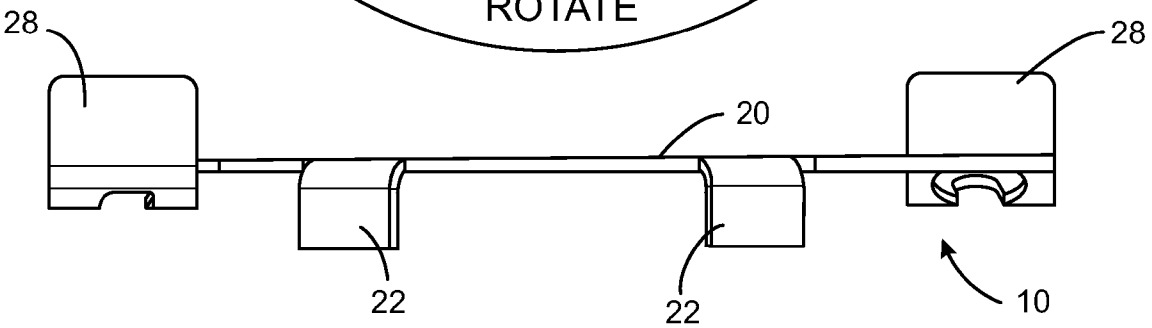
FIG. 4 is a side view of the exemplary device of FIG. 1.

Considering now FIGS. 1 and 2, FIG. 1 illustrates an exemplary device 10 being used to maintain a source of LED light 12, having a generally circular construction, to a surface of a heat sink 14. As shown in FIG. 1, the source of LED light 12 is disposed in between the device 10 and the surface of the heat sink 14 with the device 10 being secured to the surface of the heat sink 14 via use of fasteners 16. While the fasteners 16 are illustrated in the exemplary form of screws, it is to be appreciated that any form of fastener, particularly any form of fastener having an enlarged head portion (or other surface feature), may be used for this purpose. In addition, the fasteners could be formed as a part of the heat sink, e.g., the fasteners and heat sink could be die cast as a one piece element.

In some examples, at least one continuous path between the surface of the heat sink 14 and the source of LED light 12 may be formed of metal. The continuous metallic path may provide or may help provide a force acting on the source of LED light 12 in a direction towards the surface of the heat sink 14. Moreover, the continuous metallic path may essentially provide a thermal conduit back to the surface of the heat sink 14. In some examples, once the surface of the heat sink 14 and the source of LED light 12 are installed, at least a portion of the continuous metallic path may be deflected or deflectable, as described further below (e.g., tabs 24). Further, in one example, the example continuous metallic path may include and/or terminate at the fasteners that secure the device 10 to the surface of the heat sink 14. Still further, in addition or in the alternative, the continuous metallic path may contact a surface of the source of LED light 12 that is opposite the surface of the heat sink 14.

For securing the source of LED light 12 to the surface of a heat sink 14, the device 10 is provided with an aperture 18 which is surrounded by an LED light source engaging surface 20. Apertures, such as the aperture 18, for instance, may be, for example and without limitation, holes, slots, and/or other openings, etc. The LED light source engaging surface 20 is sized and arranged to engage at least a portion of the source of LED light 12. In the example shown in FIGS. 1-4, the LED light source engaging surface 20 is arranged to engage at least a portion of a corresponding surface of the source of LED light 12. For locating the source of LED light 12 between the device 10 and the heat sink 14, the device 10 may optionally include one or more LED light source locating surfaces 22. When utilized, the LED light source locating surfaces 22, which extend from the LED light source engaging surface 20 in a direction that would be towards the heat sink 14 when the device 10 is attached thereto, function to engage corresponding surfaces of the source of LED light 12.

For applying the desired forces upon the source of LED light 12 when the device 10 is secured to the heat sink surface 14 via use of the fasteners 16, the LED light engaging surface 20 includes an integrated force applying spring. In the exemplary example of FIGS. 1-4, the integrated force applying spring is in the form of at least a pair of resilient or leaf-spring like mounting tabs 24 each having a key-shaped, fastener accepting opening 26. As shown in FIGS. 1-4, the mounting tabs 24 preferably extend from opposed sides of the LED light source engaging surface 20. As particularly illustrated in FIG. 3, the mounting tabs 24 are preferably provided with a first portion **24*a* that extends from the LED light source engaging surface 20 at a first angle and a second portion 26*b* that then extends from the end of the first portion 24*a* at a second angle where the key-shaped fastener accepting opening 26 spans the first portion 24*a* and the second portion 24*b***.

To secure the device 10 upon the heat sink surface 14 and thereby secure the source of LED light 12 against the heat sink surface 14, the device 10 is first positioned such that the fastener 16 is received into a larger portion **26*a* of the key-shaped, fastener accepting opening 26 whereupon the device 10 is rotated to cause the fastener 16 to be moved into a narrower portion 26*b* of the key-shaped, fastener accepting opening 26 whereupon the device 10 is effectively locked in position. More particularly, as the device 10 is rotated, the head (or other surface feature) of the fastener 16 will be moved over a surface of the second portion 24*a* of the mounting tab 24 and the resilient or leaf-spring like nature of the mounting tab 24, acting against the head (or other surface feature) of the fastener 16, will cause the LED light source engaging surface 20 of the device 10 to generally, uniformly push the source of LED light 12 against the surface of the heat sink 14. To assist in the rotating of the device 10, e.g., to lock and unlock the source of LED light 12 against the heat sink surface 14, one or more turn assisting surfaces 28 may also be provided to the device 10. By way of example only, the turn assisting surfaces 28 may be surfaces that are formed so as to extend from the ends of the mounting tabs 24 in a direction that would be generally perpendicular to the heat sink 14 when the device 10 is attached thereto. It will be further appreciated that the example shown in FIGS. 1-4 also has the advantage of not requiring the fasteners 16 to be removed from the heat sink when it is desired to remove the source of LED light 12** therefrom.

Figure 10:
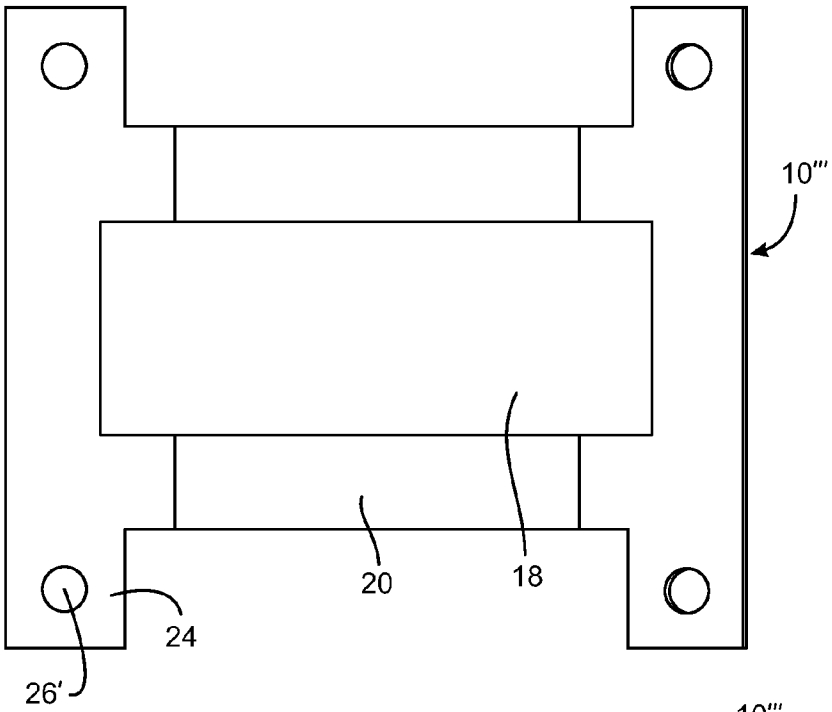
FIG. 10 is a top view of a yet further exemplary device for securing a source of LED light to a surface of a heat sink.

It is to be appreciated that the fastener accepting opening provided to the leaf-spring like mounting tabs 24 of the example shown in FIGS. 1-4 may be in the form of otherwise conventional openings such as apertures 26' shown in FIG. 10 if so desired. In such a case, the openings 26' could be provided to any surface of the leaf-spring like mounting element that would allow the leaf spring to flex for the purposes above described.

Figure 5:
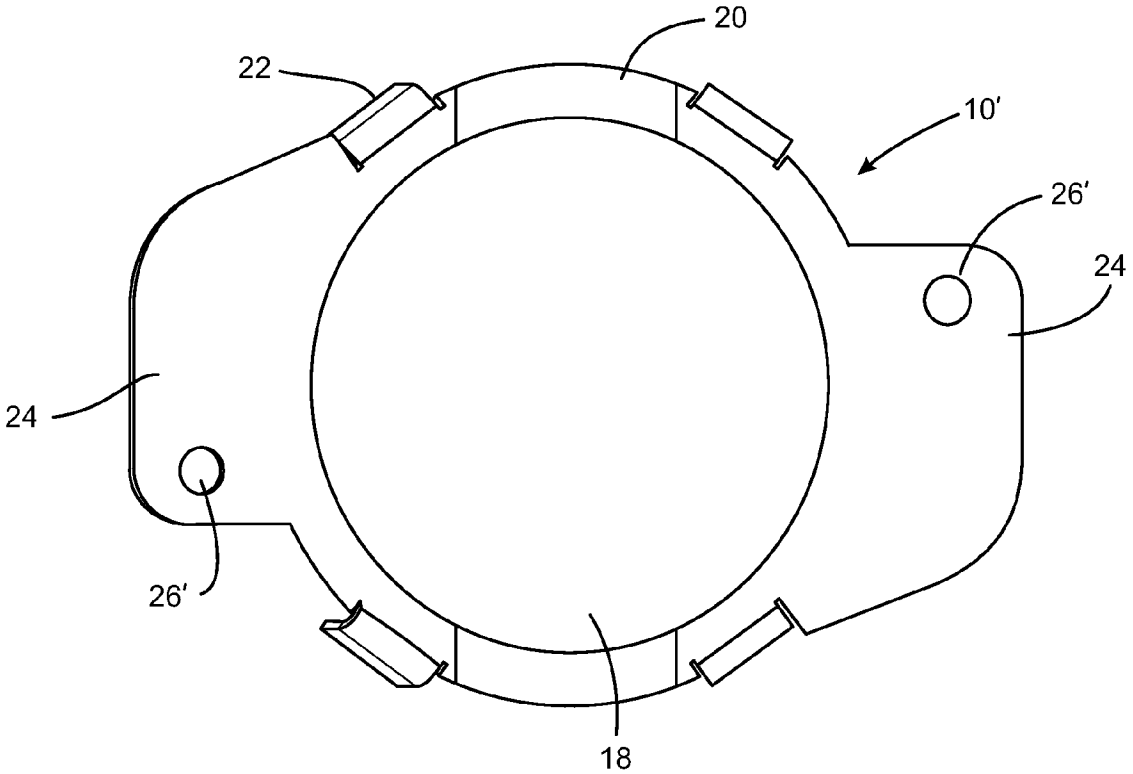
FIG. 5 is a top view of a further exemplary device for securing a source of LED light to a surface of a heat sink.
Figure 6:
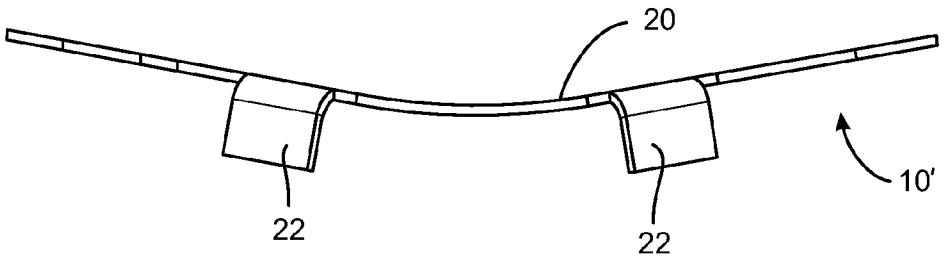
FIG. 6 is a side view of the exemplary device of FIG. 5.

Considering now FIGS. 5 and 6, a further device 10' is illustrated in which the LED light source engaging surface 20 of the example shown in FIGS. 1-4 has been provided with an integrated spring by providing the LED light engaging surface 20 with a curved configuration when the device 10' is not under load. As particularly illustrated in FIG. 6, the LED light source engaging surface 20 is preferably curved from a center axis that is generally perpendicular to an axis formed between the mounting tabs 24. Because in such an arrangement the LED light source engaging surface 20 acts as a spring to apply the forces upon the source of LED light 12 when the device 10' is secured to the heat sink surface 14, in the example shown in FIGS. 5 and 6, the mounting tabs 24 need not be provided with the bent, leaf-spring configuration that is utilized in connection with the example shown in FIGS. 1-4. Such leaf-spring mounting tabs could, however, be utilized if desired. Furthermore, in the example shown in FIGS. 5 and 6, fasteners 16 can be inserted into key-shaped openings as previously described or can be inserted into otherwise conventional fastener accepting opening 26'. In either case, when attached via use of the fasteners 16 to the heat sink 14, the LED light source engaging surface 20 will flex and thereby cause the LED light source engaging surface 20 to apply a force upon the source of LED light 12 to generally, uniformly push the source of LED light 12 against the surface of the heat sink 14.

Figure 7:
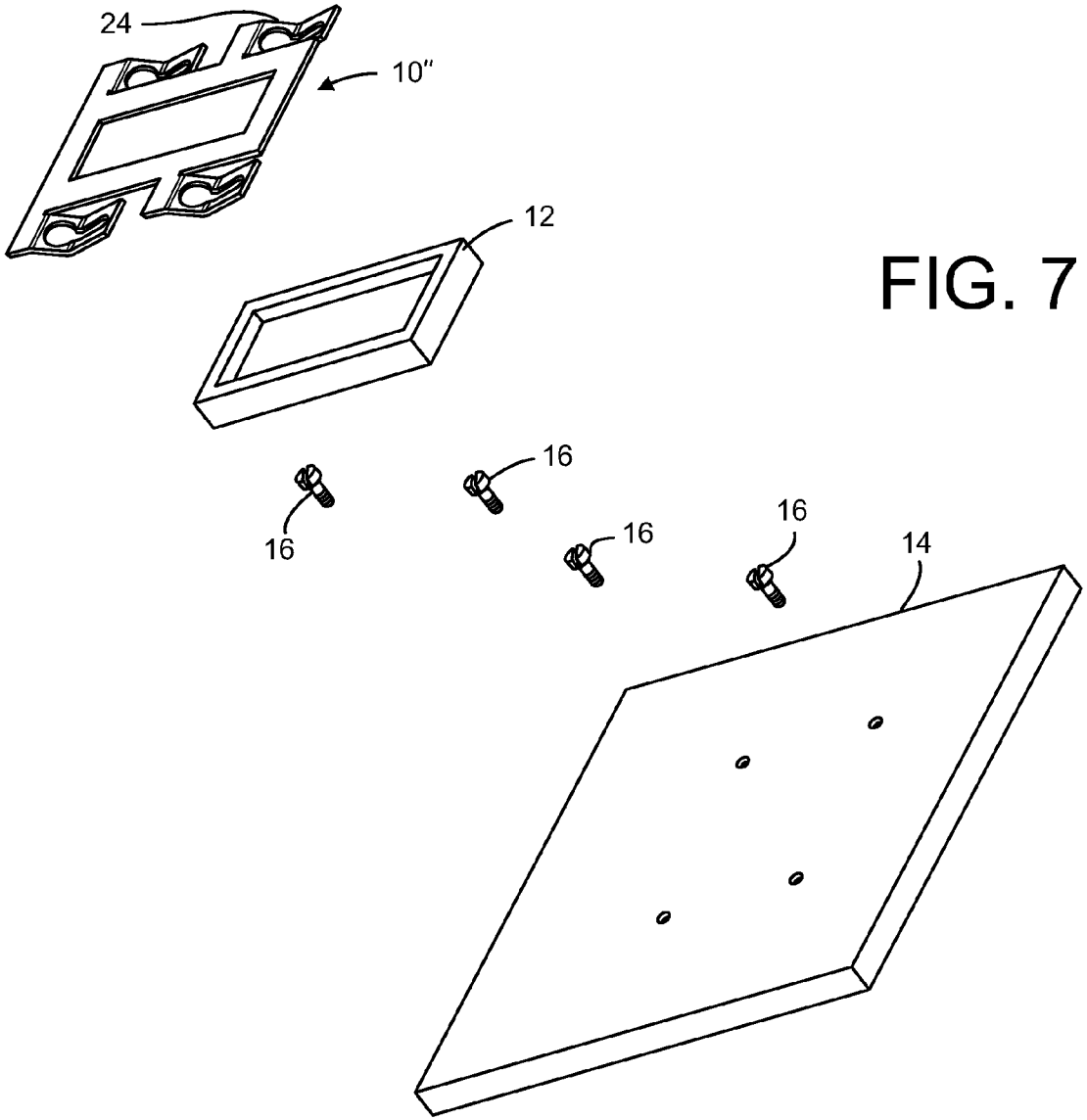
FIG. 7 illustrates an exploded view of a still further exemplary device being used to secure a source of LED light to a surface of a heat sink.
Figure 8:
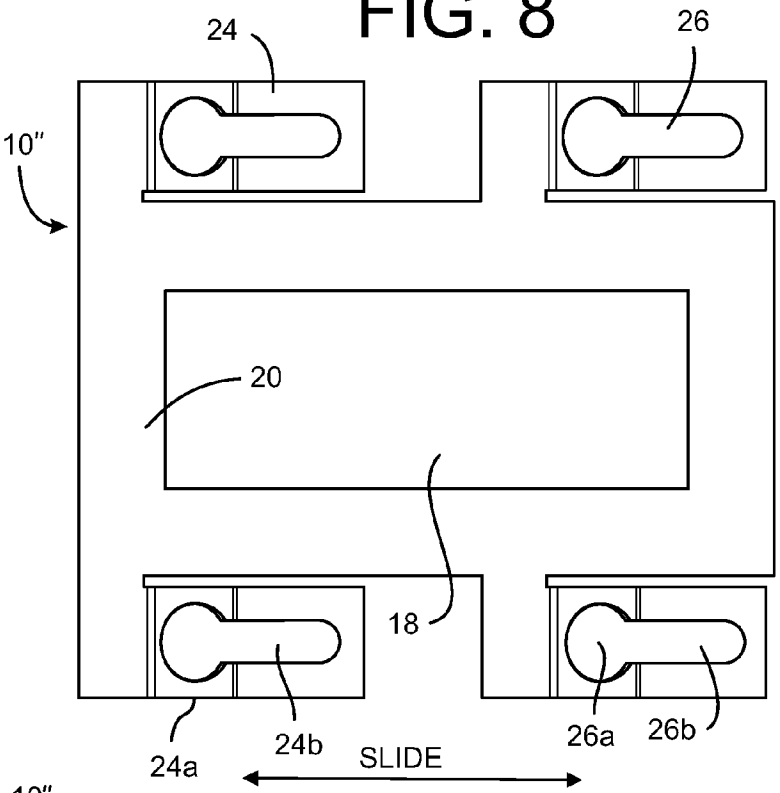
FIG. 8 is a top view of the exemplary device of FIG. 7.
Figure 9:
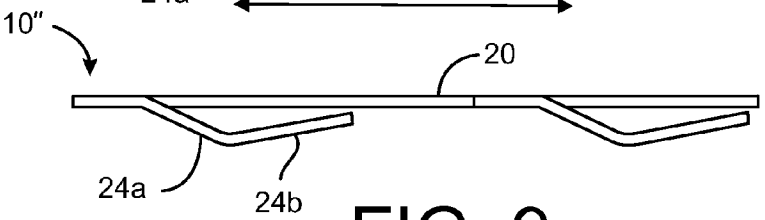
FIG. 9 is a side view of the exemplary device of FIG. 7.

Considering now FIGS. 7-9, a further device 10" is illustrated in which the generally planar LED light source engaging surface 20 of the example shown in FIGS. 1-4 has been provided with a shape for engaging a source of LED light 12 having a generally rectangular configuration. As with the example shown in FIGS. 1-4, the device 10" includes an integrated spring construction in the form of one or more leaf-spring like engagement tabs 24. The engagement tabs 24 are again arranged to cooperate with a head (or other surface feature) of a fastener 16 in the manner described above, i.e., to flex and to thereby cause the LED light source engaging surface 20 to apply a force upon the source of LED light 12 to generally, uniformly push the source of LED light 12 against the heat sink 14. Because of the rectangular configuration of the LED light source 12 in this assembly, rather than allow for the device 10" to be rotated into and out of engagement with the fasteners 16, the leaf-spring like engagement tabs 24 are arranged to allow the device 10" to be slid linearly into and out of engagement with the fasteners 16.

Figure 11:
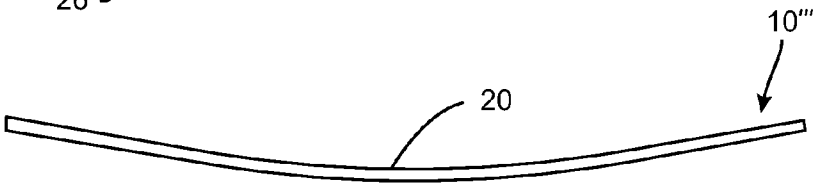
FIG. 11 is a side view of the exemplary device of FIG. 10.

Considering now FIGS. 10 and 11, a still further device 10''' is illustrated in which the LED light source engaging surface 20 of the example shown in FIGS. 7-9 has been provided with an integrated spring by providing the LED light source engaging surface 20 with a curved configuration when the device 10''' is not under load. As particularly illustrated in FIG. 11, the LED light source engaging surface 20 is curved from a center axis that is generally intermediate the pairs of mounting tabs 24. As will be appreciated, in such an arrangement, the LED light source engaging surface 20 acts as a spring to apply the forces upon the source of LED light 12 when the device 10''' is secured to the heat sink surface 14. As before, in the example shown in FIGS. 10 and 11, the mounting tabs 24 may optionally omit the bent, leaf-spring configuration that is utilized in connection with the example shown in FIGS. 7-9. Similarly, the mounting tabs 24 may optionally omit the key-shaped openings 26 and may instead utilize otherwise conventional fastener accepting opening 26'. In either instance, when the device 10''' is attached to the heat sink 14, the LED light source engaging surface 20, owing to its integrated spring configuration, will function to apply a force upon the source of LED light 12 to generally, uniformly push the source of LED light 12 against the surface of the heat sink 14.

Figure 12:
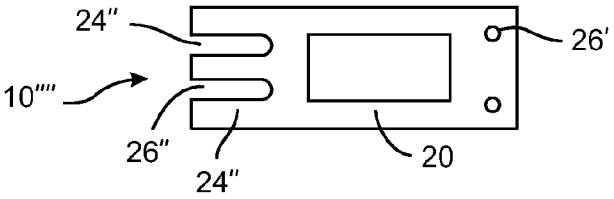
FIG. 12 is a top view of a still further exemplary device for securing a source of LED light to a surface of a heat sink.
Figure 13:
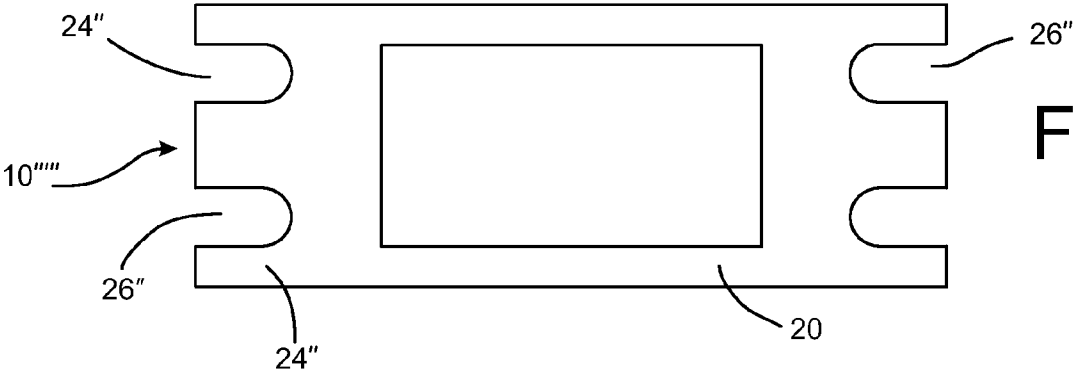
FIG. 13 is a top view of yet another exemplary device for securing a source of LED light to a surface of a heat sink.
Figure 14:
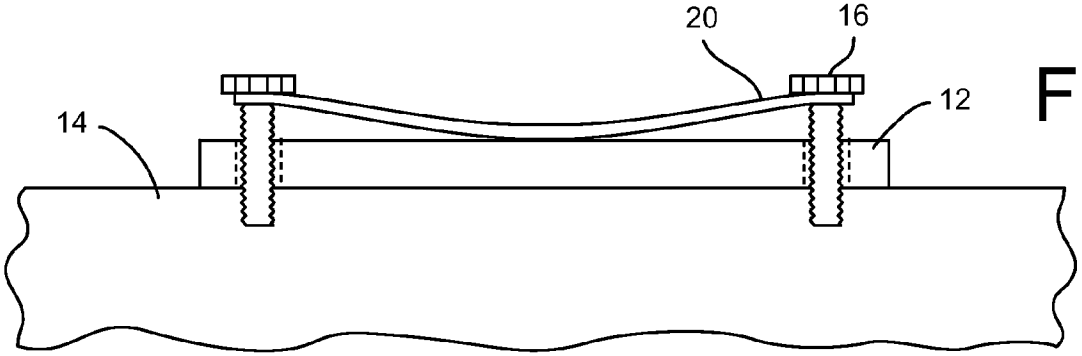
FIG. 14 is a side view of the exemplary device of FIG. 13.
Figure 18:
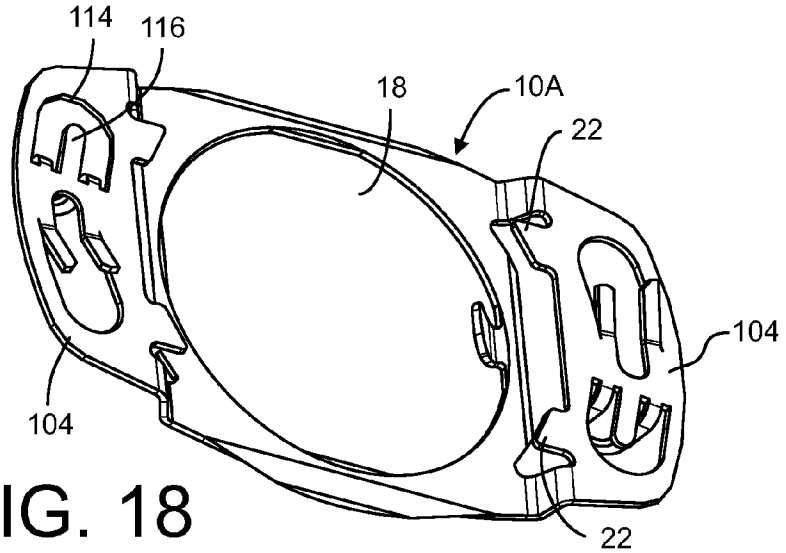
FIG. 18 is an underside view of the device of FIG. 15.
Figure 15:
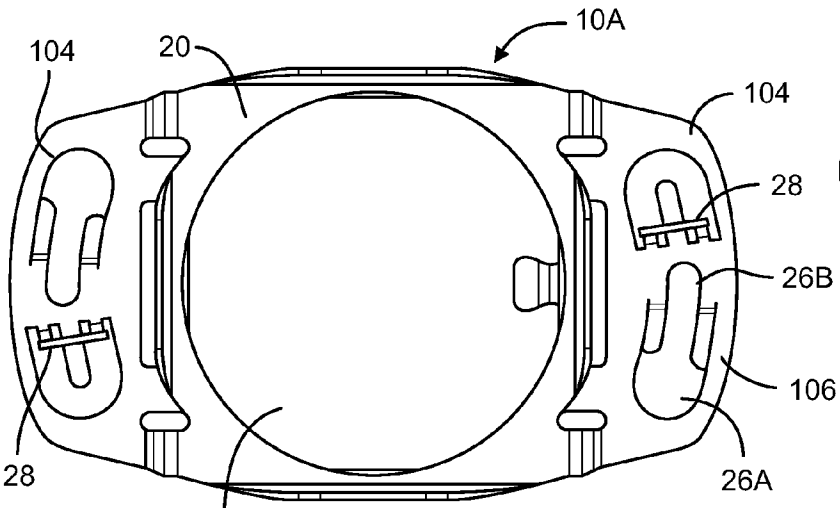
FIG. 15 is a top view of a yet further exemplary device for securing a source of LED light to a surface of a heat sink.
Figure 17:
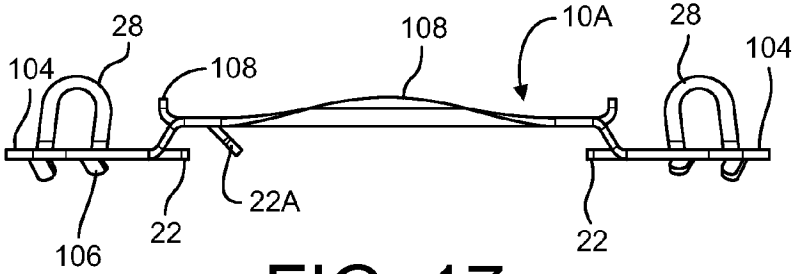
FIG. 17 is a side view of the device of FIG. 15.

In FIG. 13, a further device 10'''' is illustrated which provides slots 26" adjacent to mounting elements 24". In this manner, when a fastener 16 is received into the slots 26", e.g., by being slid therewithin, the integrated spring provided to the LED light engaging surface 20, e.g., as provided by the curved surface of the LED light engaging surface 20 as shown in FIG. 14, will function to generally, uniformly push the source of LED light 12 against the surface of the heat sink 14. While not shown, in such examples, the mounting elements could be provided with leaf-spring like or flexible elements in addition to or alternatively to providing the LED light engaging surface 20 with an integrated spring curve as noted above. In addition, as illustrated in FIG. 12, a still further device 10'''' may be provided with slots 26" for receiving fasteners 16 as well as apertures 26'. As will be understood, the use of such slots 26" may allow for the removal of the device and/or removal of the source of LED light from under the device without requiring removal of all of the fasteners 16 from the heat sink 14.

Considering now FIGS. 15-20, a further exemplary device 10A is illustrated for use in maintaining a source of LED light 12 against a surface of a heat sink 14. As before, the source of LED light 12 will be disposed between the device 10A and the surface of the heat sink 14 with the device 10A being secured to the surface of the heat sink 14 via use of fasteners 16. The device 10A is provided with an aperture 18 which is surrounded by an LED light source engaging surface 20. The LED light source engaging surface 20 is sized and arranged to engage at least a portion of the source of LED light 12. In the example shown in FIGS. 15-20, the LED light source engaging surface 20 is arranged to engage at least a portion of a corresponding surface of the source of LED light 12. For locating the source of LED light 12 between the device 10A and the heat sink 14, the device 10A may include one or more LED light source locating surfaces 22A. More particularly, the LED light source locating surfaces 22A may be elastically deflected to hold the LED light source to the device 10A before positioning to the LED mounting surface 20 to aid assembly and field replacement. When utilized, the LED light source locating surfaces 22A, which extend from the LED light source engaging surface 20 in a direction that would be towards the heat sink 14 when the device 10A is attached thereto, function to engage a corresponding feature 100 provided to the source of LED light 12. The device 10A may also be provided with light source engaging surfaces 22 for engaging corresponding sides of the source of LED light 12.

Figure 16:
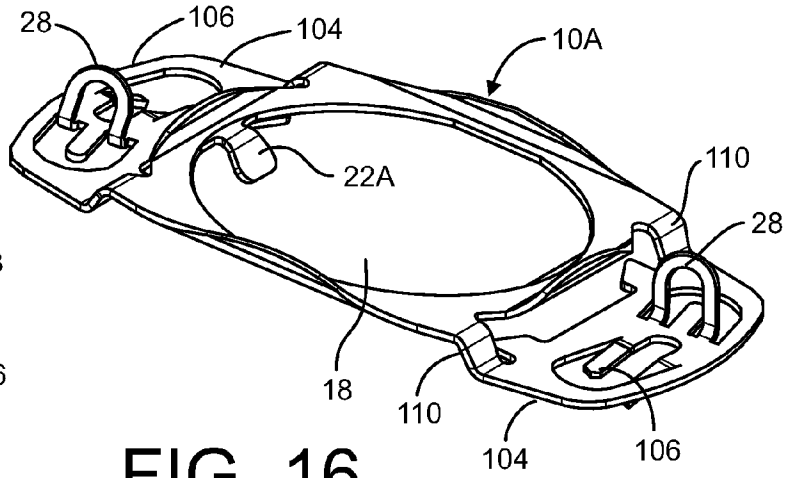
FIG. 16 is a perspective view of the device of FIG. 15.
Figure 16A:
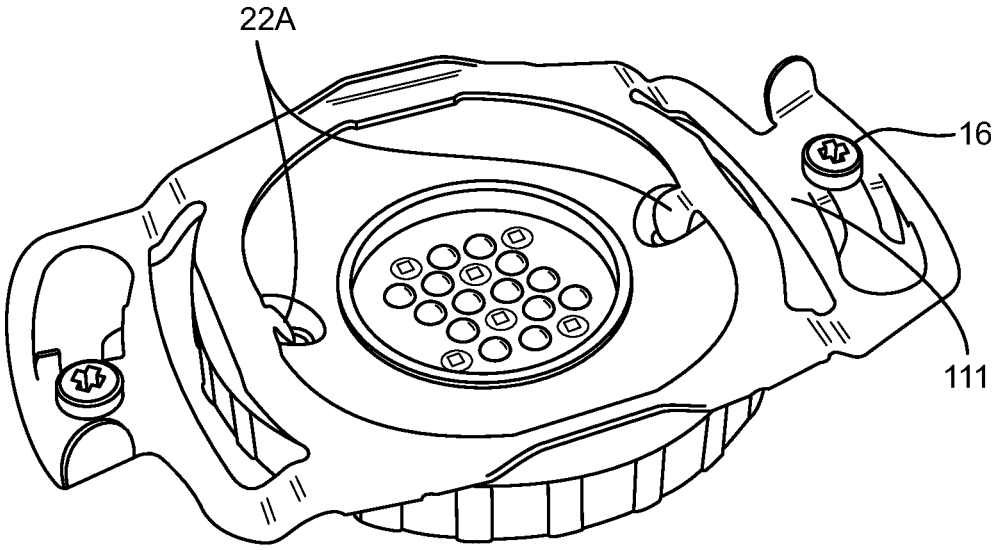
FIG. 16A is perspective view of a still further example device for securing a source of LED light to a surface of a heat sink.
Figure 19:
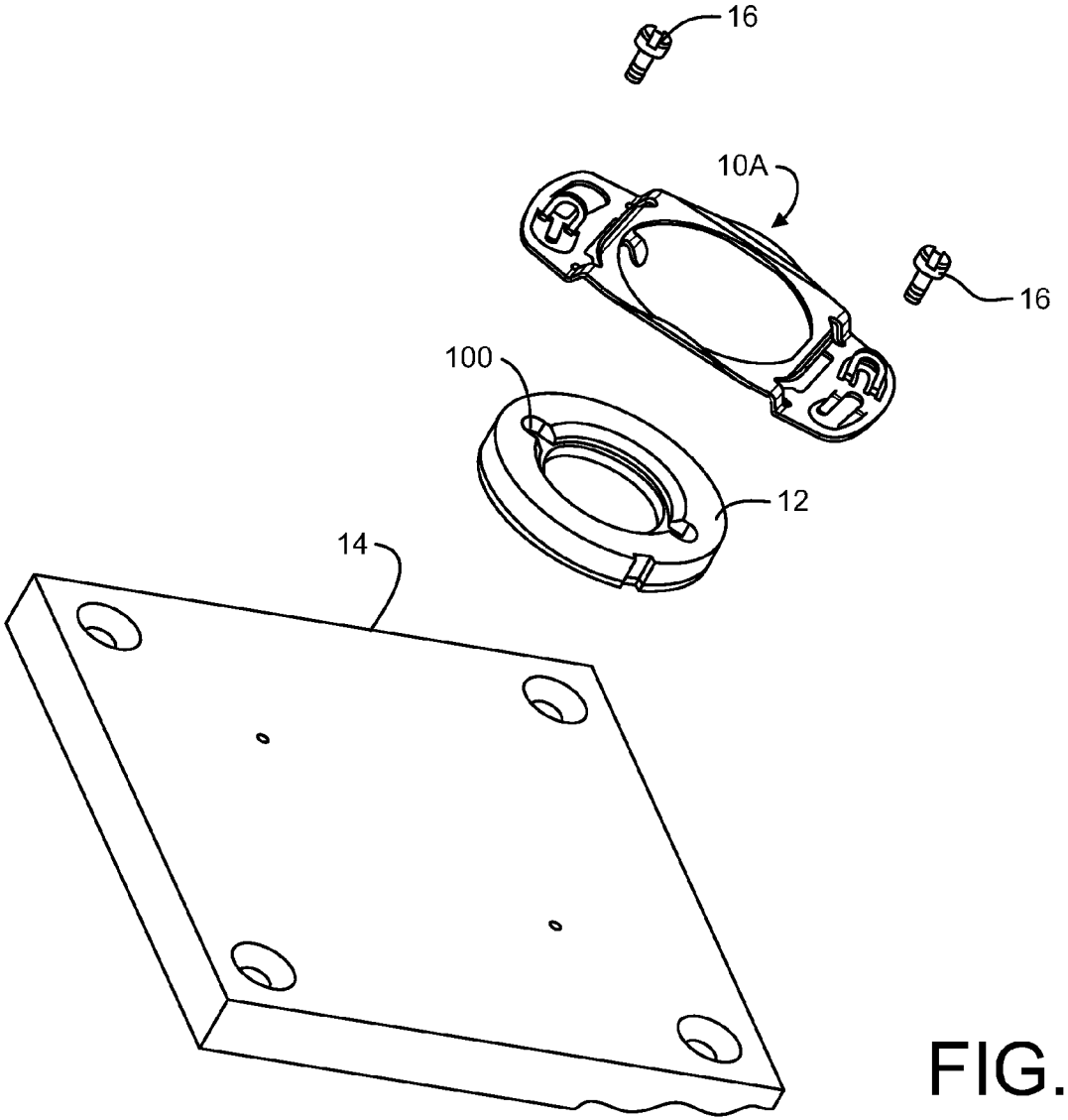
FIG. 19 is an exploded view of an assembly including the device of FIG. 15.
Figure 20:
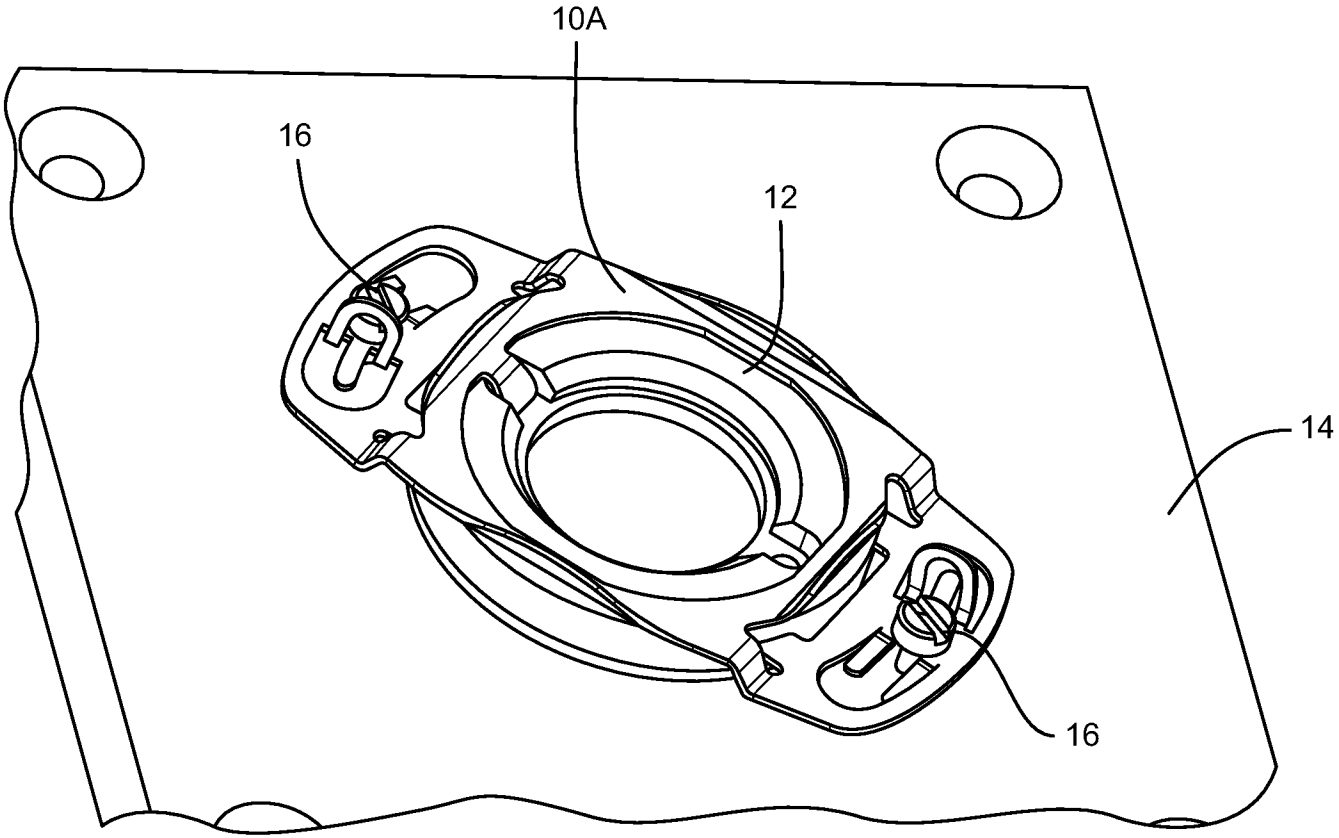
FIG. 20 is a view of the assembly of FIG. 19 constructed.

For applying the desired forces upon the source of LED light 12 when the device 10A is secured to the heat sink surface 14 via use of the fasteners 16, the device 10A is provided with a pair of opposed mounting elements 104 each of which carries a key-shaped, fastener accepting opening 26. As shown in FIGS. 15-20, the mounting elements 104 preferably extend from opposed sides of the LED light source engaging surface 20. Thus, to secure the device 10A upon the heat sink surface 14 and thereby secure the source of LED light 12 against the heat sink surface 14, a fastener 16 is first received into a larger portion 26*a* of the key-shaped, fastener accepting opening 26 whereupon the device 10 is moved to cause the fastener 16 to be moved into a narrower portion 26*b* of the key-shaped, fastener accepting opening 26. More particularly, as the device 10 is rotated, the head (or other surface feature) of the fastener 16 will be moved over a surface 106 associated with the mounting element 104 and the head (or other surface feature) of the fastener 16, acting in cooperation with the mounting element 104, will drive the mounting element towards the heat sink 14 and thereby cause the LED light source engaging surface 20 of the device 10A to generally, uniformly push the source of LED light 12 against the surface of the heat sink 14. To assist in the rotating of the device 10A, e.g., to lock and unlock the source of LED light 12 against the heat sink surface 14, one or more turn assisting surfaces 28 may also be provided to the device 10. By way of example only, the turn assisting surfaces 28 may be surfaces that are formed so as to extend from the mounting elements 104 in a direction that would be generally perpendicular to the heat sink 14 when the device 10A is attached thereto. Once assembled, one or more anti-rotation features 111 (e.g., a bump) such as that shown in FIG. 16A, for example, may help prevent the fastener 16 from rotating with respect to the device 10A. The anti-rotation feature 111 shown in FIG. 16A may contact an underside of a head of the fastener 16. It will be again be appreciated that the example shown in FIGS. 15-20 has the advantage of not requiring the fasteners 16 to be removed from the heat sink when it is desired to remove the source of LED light 12 therefrom. The device 10A may additionally be provided with rib-like elements 108 to assist in maintaining the rigidity of the LED mounting surface 20 as the legs 110 leading between the LED mounting surface 20 and the mounting elements 104 are caused to flex when the device 10A is secured upon the heat sink 14. Furthermore, because the example illustrated in FIGS. 15-20 is provided with an opening 114 (as a result of the manufacturing process) which is not intended to be used to receive a fastener 16, the opening 114 is provided with an element 116 that is intended to inhibit the introduction of a fastener 16 into the opening 114.

Figure 22:
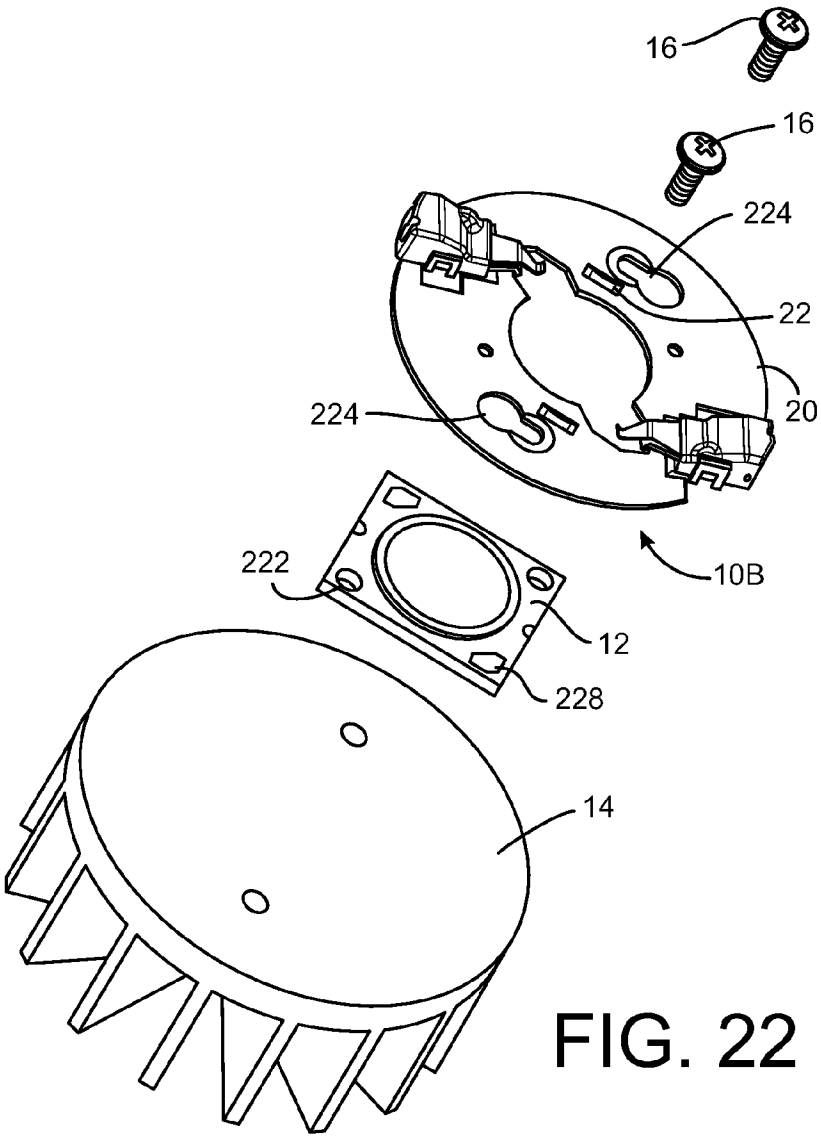
FIG. 22 illustrates an exploded view of the assembly illustrated in FIG. 21.
Figure 21:
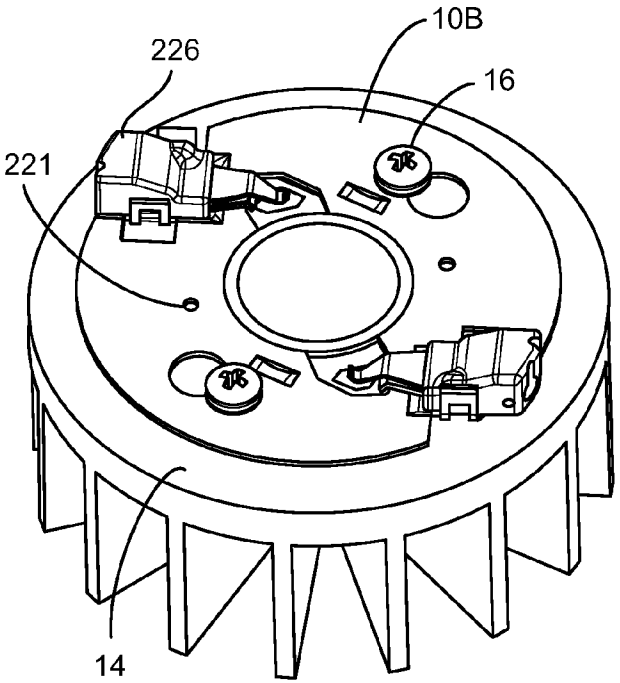
FIG. 21 illustrates a still further exemplary device being used to secure a source of LED light to a surface of a heat sink.
Figure 24:
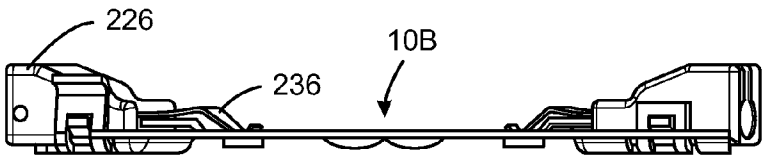
FIG. 24 illustrates a side view of the LED holder and contact cartridge of FIG. 23.
Figure 25:
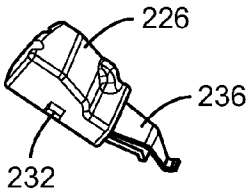
FIG. 25 illustrates an exploded view of the LED holder and contact cartridge of FIG. 23.
Figure 25:
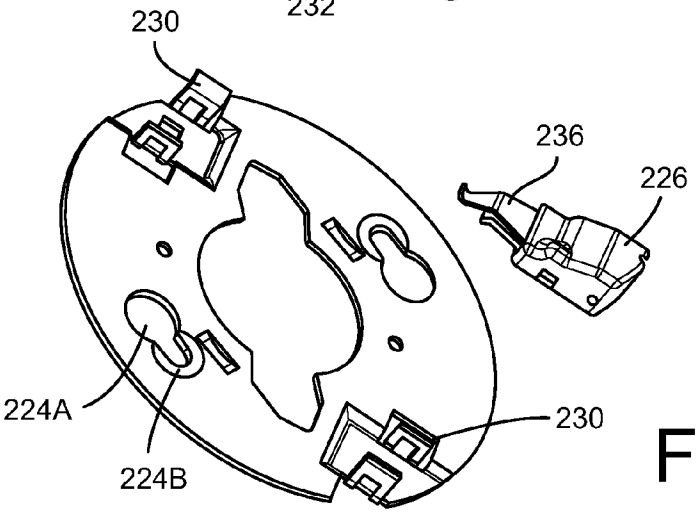

Considering now FIGS. 21-25, a further exemplary device 10B is illustrated. The device 10B is used to maintain a source of LED light 12 upon a surface of a heat sink 14. As shown in FIGS. 21 and 22, the source of LED light 12 is disposed in between the device 10B and the surface of the heat sink 14 with the device 10B being secured to the surface of the heat sink 14 via use of fasteners 16 or other feature of the mounting surface. Generally, when the device 10B is attached to the heat sink 14, e.g., by being screwed down thereupon, the device 10B functions to "sandwich" the source of LED light 12 between the device 10B and the heat sink 14. Though in its free state the device 10B is planar, when under load the device 10B flexes and acts as a single leaf spring to thereby provide the securing force.

More particularly, for securing the source of LED light 12 to the surface of a heat sink 14, the device 10B is provided with an aperture 18 which is surrounded by an LED light source engaging surface 20. The LED light source engaging surface 20 is sized and arranged to engage at least a portion of the source of LED light 12. In the example shown in FIGS. 21-25, the LED light source engaging surface 20 is arranged to engage at least a portion of a corresponding surface of the source of LED light 12. For locating the source of LED light 12 between the device 10B and the heat sink 14, and for preventing rotation of the source of LED light 12, the device 10B may optionally include one or more LED light source locating surfaces 22. When utilized, the LED light source locating surfaces 22 extend towards the heat sink 14 and are located at positions whereby the LED light source locating surfaces 22 will be able to engage with corresponding surfaces of the source of LED light 12. In addition or alternatively, and for these same purposes, the device 10B may be provided with protuberances 221 which are sized and arranged to engage with corresponding recesses 222 provided to the source of LED light 12.

For applying the desired forces upon the source of LED light 12 when the device 10B is secured to the heat sink surface 14 via use of the fasteners 16, the LED light engaging surface 20 includes key-shaped fastener accepting openings 224. As shown in the figures, the fastener accepting openings 224 include a first portion 224A which is sized larger than the head (or other surface feature) of the fastener 16 (to thereby allow the device 10A to be removed from the heat sink 14 without requiring removal of the fasteners 16) and a second portion which is sized smaller than the head (or other surface feature) of the fastener 16 (to thereby hold the device 10A against the heat sink 14 via the cooperation of the head (or other surface feature) of the fasteners 16 and the LED light engaging surface 20). It should be understood that one advantage of the openings, such as the openings 224 in FIG. 23 or the openings 26, 26A in FIGS. 8 and 15, for example, is to receive screws inserted into the heat sink surface 14 before the device 10 is installed. While not required, the area adjacent to the first portion 224A could be provided with an angled surface to thereby force the device 10A downwardly toward the heat sink 14 when the device 10B is turned relative to the fasteners 16, i.e., the device 10A is moved to cause the fasteners 16 to transition from the first portion 224A to the second portion 224B of the fastener accepting opening 224. More particularly, to secure the device 10B upon the heat sink surface 14 and thereby force the source of LED light 12 against the heat sink surface 14, the device 10B is first positioned such that the fastener 16 is received into a larger portion 224A of the key-shaped, fastener accepting opening 224 whereupon the device 10B is rotated to cause the fastener 16 to be moved into the narrower portion 224B of the key-shaped, fastener accepting opening 224. As the device 10B is rotated in this manner, the fastener 16 will be moved into engagement with the LED light engaging surface 20 and the device 10B, acting against the fastener 16, will generally, uniformly push the source of LED light 12 against the surface of the heat sink 14. As before, other fastener accepting openings can be utilized with this example to achieve the same results.

Figure 23:
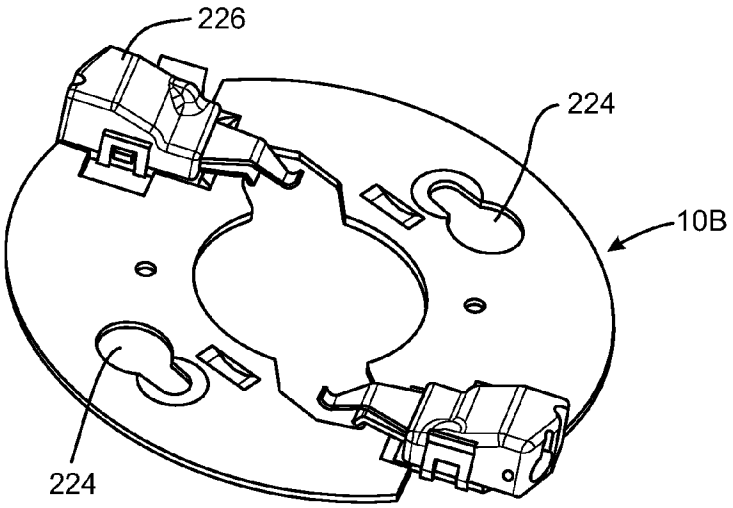
FIG. 23 illustrates a perspective view of the device of FIG. 21 and an optional contact cartridge provided thereto.
Figure 23A:
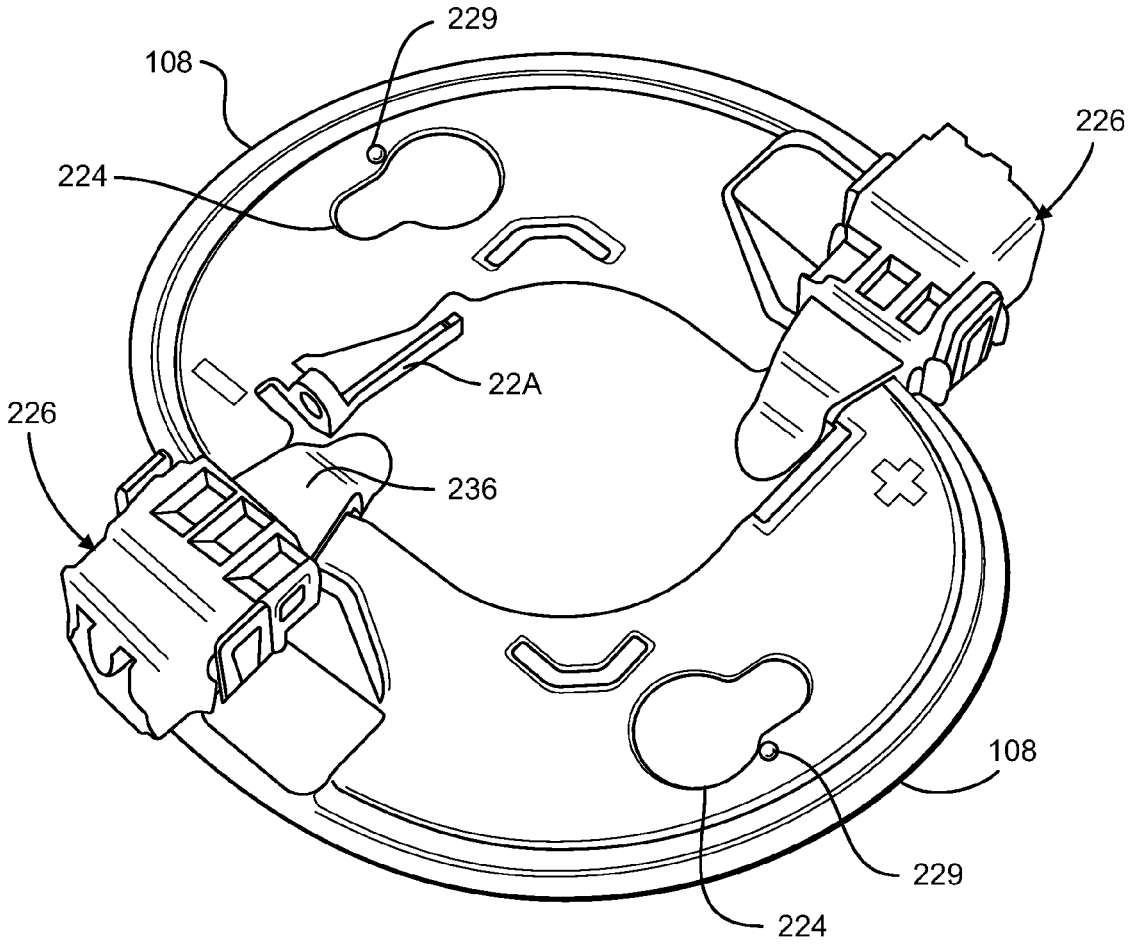
FIG. 23A illustrates a perspective view of another example device for use in securing a source of LED light to a surface of a heat sink.

With reference to device 10B, although applicable to other of the described devices, the device 10B may be optionally provided with one or more electrical connector sub-assemblies 226. The connector sub-assemblies 226 may be integral with the device 10B or removeably attached to the device 10B, such as by being snap fit thereto—for example via cooperation of leaf springs 230 used to engage recesses 232 formed in the housing of the connector sub-assemblies 226 as illustrated in FIGS. 21-25. The connector sub-assemblies 226 may be attached to either side of the device 10B depending on the requirements of the application. If located on the same side of the device 10B as the mounting surface 20, the connector sub-assemblies 226 may be disposed within or partially within the mounting surface 20 to provide a low-profile solution. As such, the connector sub-assemblies 226 may be said to break the plane of the mounting surface 20. The connector sub-assemblies 226 function to provide a means for a wire to be electrically coupled to an electrical contact pad 228 of the source of LED light 12. To this end, the connector sub-assemblies 226 include an electrical connector element (which is preferably insulated via the material of housing or other material) having at least one resilient first end 236 which is generally biased so as to engage a corresponding one of the electrical contact pads 228 of the source of LED light 12 when the source of LED light 12 is installed with the device 10B and at least one second end for accepting a wire. Without limitation, the at least one second end of the electrical connector element may provide for a crimp connection to a wire, a clamping connection to a wire, a push-in connection to a wire, and the like. Moreover, in one example, such as that shown in FIG. 23A for instance, the connector sub-assemblies 226 may be flexing insulators having resilient first ends 236 that extend to and/or over the electrical contact pad 228 of the source of LED light 12. In addition, in the example shown in FIG. 23A, the device 10A includes anti-rotation features 229 near the fastener accepting openings 224 to help prevent the fasteners 16 from loosening. Still further, as disclosed above, the device 10A may include one or more LED light source locating surfaces 22A for locating the source of LED light 12 between the device 10A and the heat sink 14. To aid assembly and field replacement, the LED light source locating surfaces 22A may be elastically deflected to hold the LED light source to the device 10A before positioning to the LED mounting surface 20.

Figure 26:
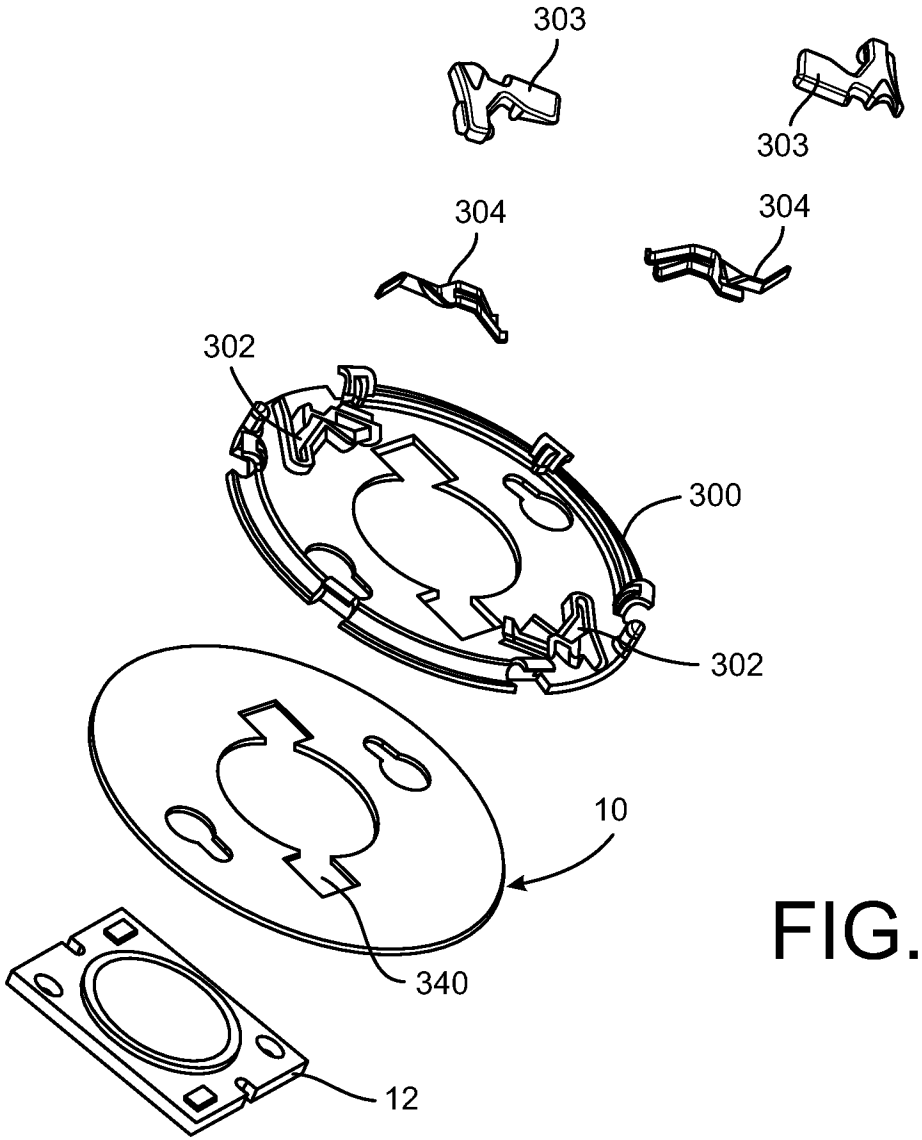
FIG. 26 illustrates an exploded view of a LED holding device and an optional electric contact base.
Figure 27:
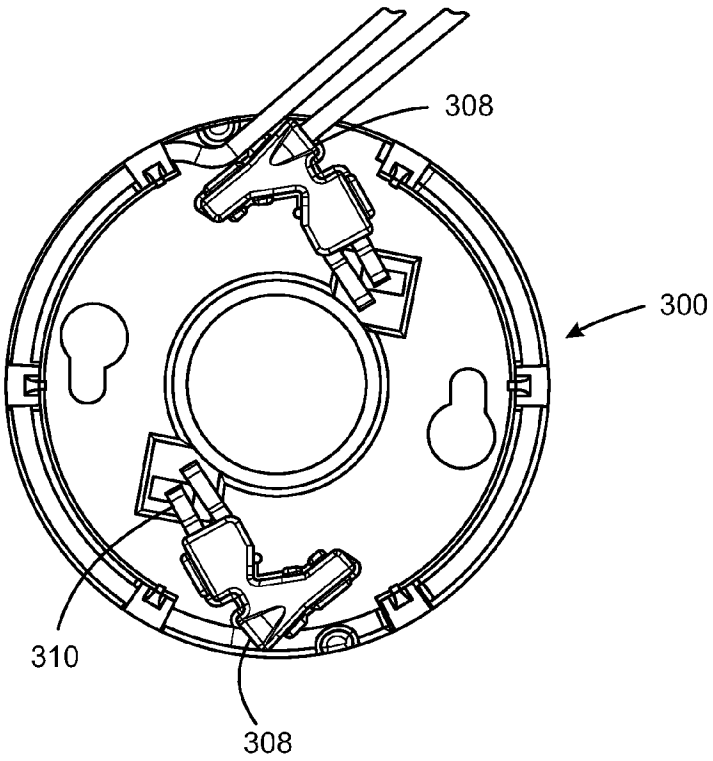
FIG. 27 illustrates a top view of the electric contact base of FIG. 26.
Figure 28:
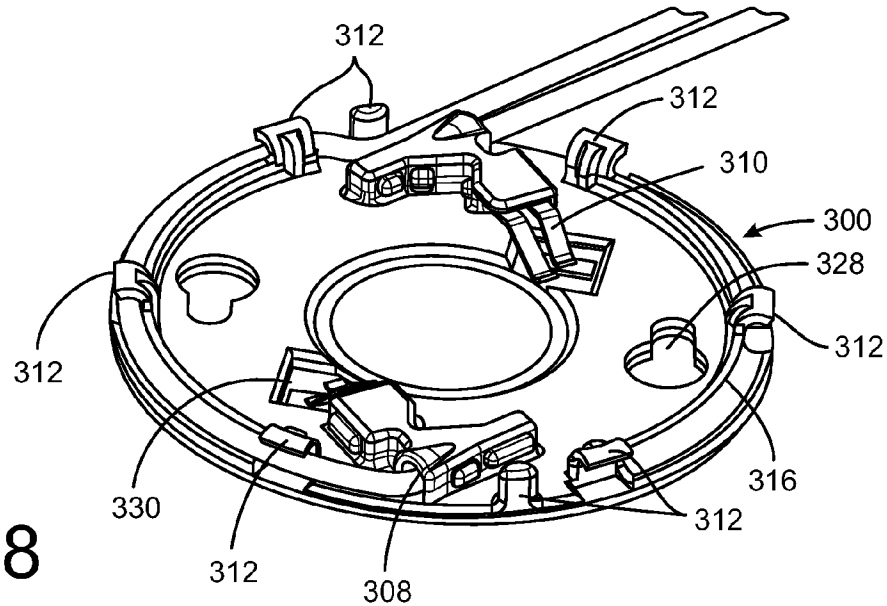
FIG. 28 illustrates a perspective view of the electric contact base of FIG. 26.
Figure 29:
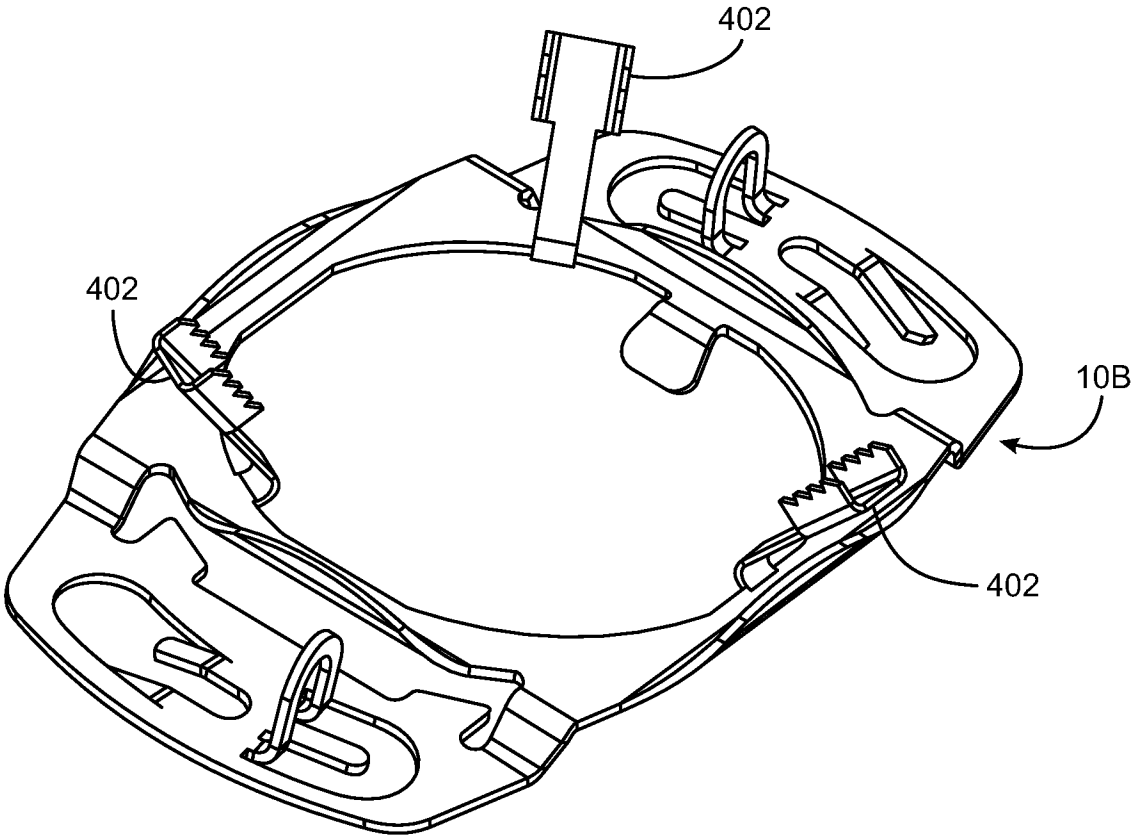
FIG. 29 illustrates a device having an optional accessory holding element.
Figure 30:
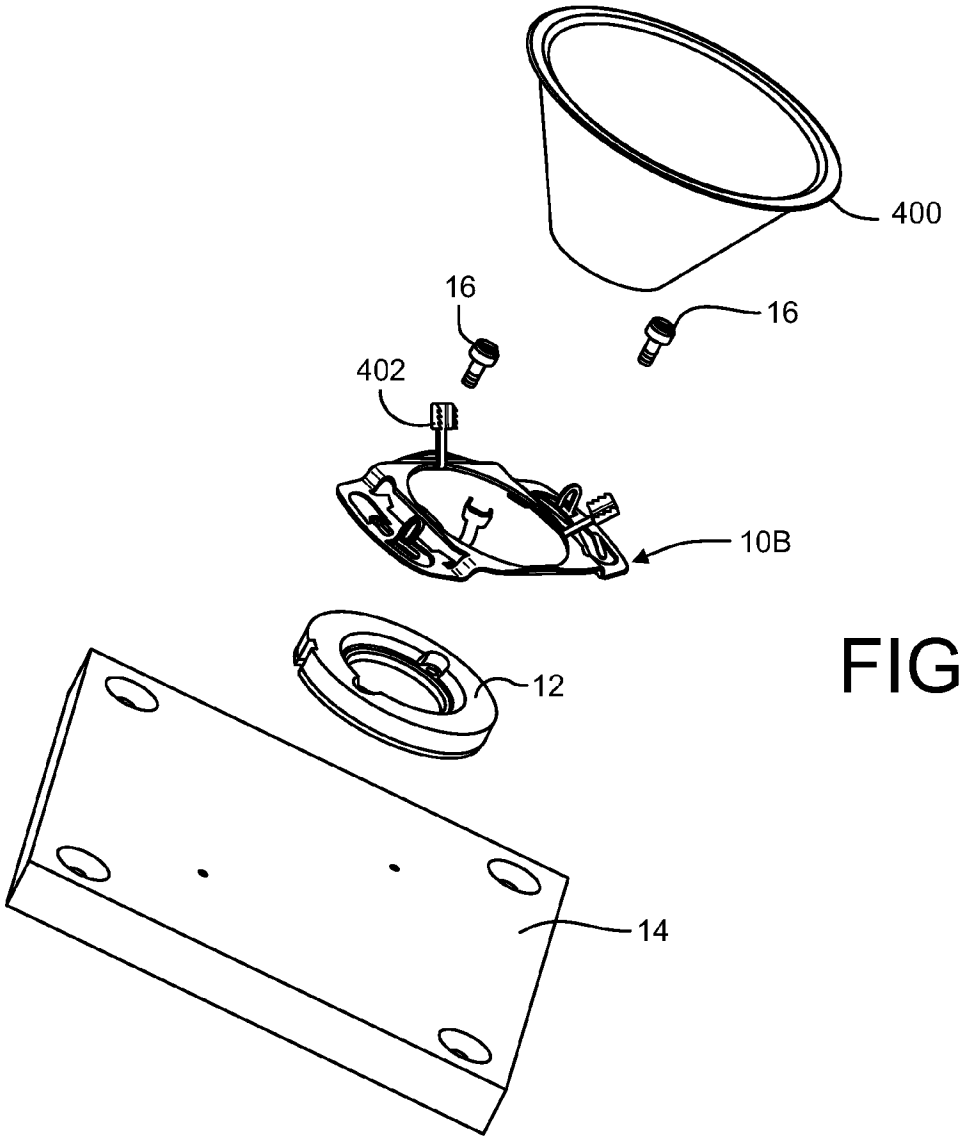
FIG. 30 illustrates an exploded view of an assembly including the device of FIG. 29.
Figure 31:
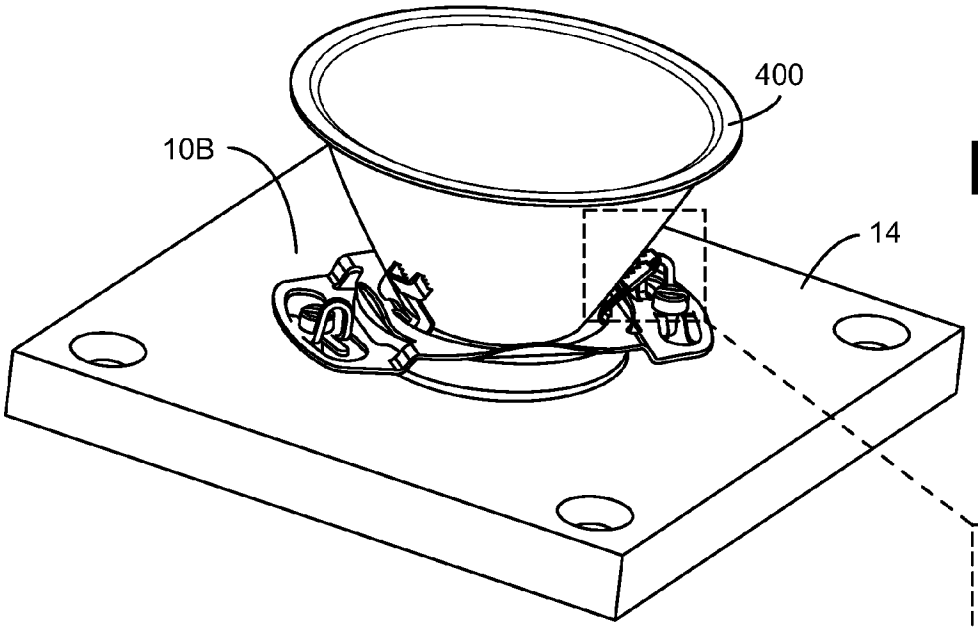
FIG. 31 illustrates the assembly of FIG. 30 assembled.
Figure 32:
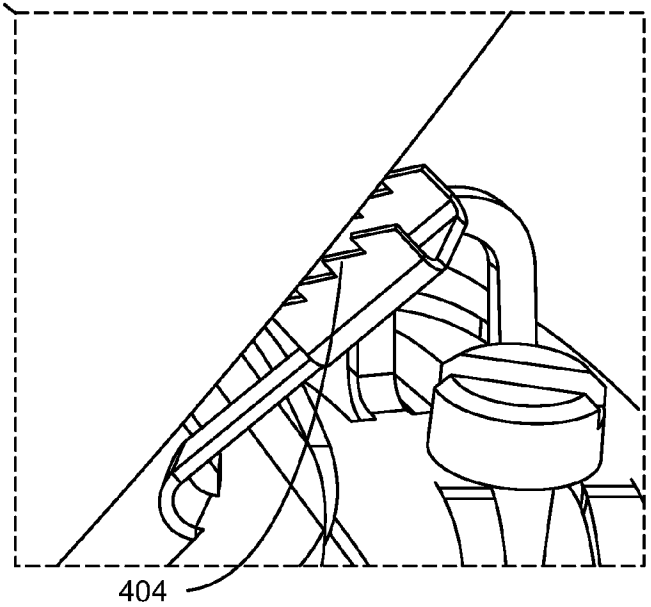
FIG. 32 illustrates a close-up view of the accessory holding elements of FIG. 29.

In a yet further example illustrated in FIGS. 26-28, a device 10 may be installed between the source of LED light 12 and an electrical contact base 300. The electrical contact base 300 supports one or more housing elements 302, which are capped via use of cover elements 303, in which are carried electrical contact elements 304. In a preferred example, the electrical contact base 300 is constructed from a plastic or other insulating material. The electrical contact elements again provide a means for a wire-fed into a wire port 308 of the housing elements 302- to be electrically coupled to an electrical contact pad 228 of the source of LED light 12. It will be appreciated that in at least one example, the electrical contact elements may include a plurality of wire ports 308 to affect a daisy chain or other type of electrical connection. To this end, the electrical contact elements 304 have at least one resilient first end 310 which is generally biased so as to engage a corresponding one of the electrical contact pads 228 of the source of LED light 12 when the source of LED light 12 is installed with the device 10 and at least one second end for accepting a wire. The second end for accepting a wire may be any suitable wire acceptor including, for instance, a push-in type connector. In certain circumstances, the electrical contact elements 304 may be provided with at least two resilient first ends 310 as illustrated to thereby allow the same assembly to be used with differently oriented electrical contact pads 228 of different sources of LED light 12. While the second end of the electrical connector element is illustrated as providing a push-in type connection, it will be appreciated that the at least one second end of the connector may provide for a crimp connection to a wire, a clamping connection to a wire, or the like without limitation.

For securing wire to the electrical contact base 300, one or more securing elements 312 are carried by the electrical contact base 300. The securing elements 312 may be integrally formed with the electrical contact base 300 or be elements added thereto. The securing elements 312 are also preferably provided with some resiliency to thereby allow wire placed therein to be clamped at a location that is spaced from the opening 18. The securing elements 312 may be arranged adjacent to a guide channel 316 also formed on the electrical contact base 300. As will be appreciated, the electrical contact base 300 includes key-shaped elements 328 or the like for accepting fasteners 16 as well as openings 330 through which the electrical contacts are able to contact with the contact pads 228 of the source of LED light 12. If an electrical contact base 300 is to be utilized with a device 10, it will also be understood that the device 10 should also be provided with cutouts or openings 340 to allow the electrical contacts to contact the contact pads 228 of the source of LED light 12 as seen in FIG. 26.

It should be understood that although components for electrical connections are generally shown on the mounting surface 20 of the device 10, the present disclosure contemplates disposing these components, such as the one or more housing elements 302, the electrical contact elements 304, and the connector sub-assemblies 226, for example, on a surface of the device 10 opposite the mounting surface 20, or partially within the mounting surface 20.

For use in holding and centering a reflector 400 or other accessory, the device 10 may be provided with optional reflector securing elements 402 as shown in FIGS. 29-32. The securing elements 402 are resiliently coupled to the device 10 and provide a clamping force upon the reflector 400 when the reflector 400 is positioned therebetween. To assist in maintaining the reflector 400 upon the device 10, the securing elements 402 may be provided with teeth 404 for gripping the outer surface of the reflector 400.

Figure 33:
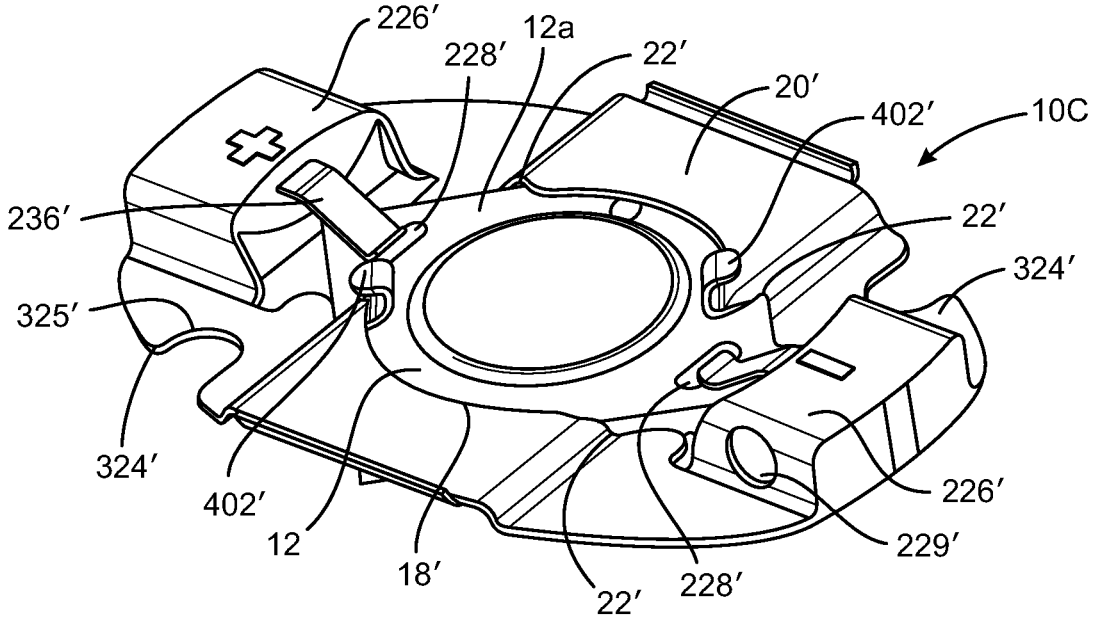
FIG. 33 illustrates a perspective view of another example device for use in securing a source of LED light to a supporting surface.

Referring now to FIG. 33, yet another example of a device 10C that is usable to secure the LED light 12 is illustrated. As with the previously disclosed example, the device 10C may be used to maintain the source of LED light 12 upon the surface of the heat sink 14, which not shown in this example. As will be understood by one of ordinary skill in the art, once installed, the source of LED light 12 is disposed in-between the device 10C and an upper surface of the heat sink with the device 10C being secured to the heat sink via use of fasteners (as shown in FIG. 22) or other feature of the mounting surface. Generally, when the device 10C is attached to the heat sink 14, e.g., by being screwed down thereupon, the device 10C functions to "sandwich" the source of LED light 12 between the device 10C and the heat sink 14. Though in its free state the device 10C is generally planar, when under load, the device 10C may flex and act as a single leaf spring to thereby provide the securing force to the LED light 12.

More particularly, similar to the previous described examples, for securing the source of LED light 12 to the surface of a heat sink 14, the device 10C is provided with an aperture 18' which is surrounded by an LED light source engaging surface 20'. The LED light source engaging surface 20' is sized and arranged to engage at least a portion of the source of LED light 12. In the example shown in FIG. 33, the LED light source engaging surface 20' is arranged to engage at least a portion of a corresponding upper surface 12*a* of the source of LED light 12. The LED light source engaging surface 20' is, in this example, a single thickness on the top surface of the LED light source. In other words, the device 10C is a "low-profile" device having a single thickness of sheet metal on top of the LED light source. For locating the source of LED light 12 between the device 10C and the heat sink 14, and for preventing rotation of the source of LED light 12, the device 10C may optionally include one or more LED light source locating surfaces 22'. When utilized, the LED light source locating surfaces 22' provide a shoulder-type surface that extend towards the heat sink 14 and are located at positions whereby the LED light source locating surfaces 22' will be able to engage with corresponding perimeter and/or surfaces of the source of LED light 12 to prevent relative movement of the LED light 12 relative to the device 10C.

For applying the desired forces upon the source of LED light 12 when the device 10C is secured to the heat sink surface 14 via use of the fasteners, the example LED light engaging surface 20' includes at least one notch-shaped fastener accepting opening 324'. As shown in FIG. 33, the fastener accepting openings 324' includes a perimeter, which in this instance is open along at least a portion. The perimeter 325' is sized smaller than the head (or other surface feature) of the fastener 16 (to thereby hold the device 10C against the heat sink 14 via the cooperation of the head (or other surface feature) of the fasteners 16. The open portion of the perimeter 325' is sized larger than the fastener shaft to thereby allow the device 10C to be rotated and removed from the heat sink 14 without requiring complete removal of the fasteners 16.

It will be appreciated by one of ordinary skill in the art that at least one advantage of the example openings, such as the openings 324', is to receive screws and/or other fasteners inserted into the heat sink surface 14 before the device 10C is installed. While not required, the area adjacent to the perimeter of the openings 325' could be provided with an angled surface to thereby force the device 10C downwardly toward the heat sink 14 when the device 10C is turned relative to the fasteners 161*t* will be appreciated by one of ordinary skill in the art that other fastener accepting openings can be utilized with this example to achieve the same results.

With reference to the example device 10C, as with the other described devices, the example device 10C is provided with one or more electrical connector sub-assemblies 226'. In this example, the connector sub-assemblies 226' are integrally assembled to the device 10C, but the assemblies may be removeably attached to the device 10C, such as by being inteference-fit thereto, by adhesives, solder, etc. As with previously disclosed examples, the connector sub-assemblies 226' may be attached to either side of the device 10B depending on the requirements of the application.

The example connector sub-assemblies 226' function to provide a means for a wire to be electrically coupled to an electrical contact pad 228' of the source of LED light 12. To this end, the connector sub-assemblies 226' include an electrical connector element (which is preferably insulated via the material of housing or other material) having at least one resilient first end 236' which is generally biased so as to engage a corresponding one of the electrical contact pads 228' of the source of LED light 12 when the source of LED light 12 is installed with the device 10C and at least one second end 229' for accepting a wire. Without limitation, the at least one second end of the electrical connector element may provide for a crimp connection to a wire, a clamping connection to a wire, a push-in connection to a wire, or the like.

Moreover, as shown in the example of FIG. 33 for instance, the connector sub-assemblies 226' may be flexing insulators or conductors having resilient first ends 236' that extend to and/or over the electrical contact pads 228' of the source of LED light 12. In this instance, the first ends 236' may provide an additional biasing force to the LED light 12 against the heat sink 14 when the device 10C is installed.

For use in holding and centering the reflector 400 or other accessory, the example device 10C is provided with optional reflector securing elements 402'. The securing elements 402' are resilient and integrally formed with the device 10C to provide a clamping force upon the reflector 400 when the reflector 400 is positioned therebetween. It will be appreciated by one of ordinary skill in the art that while two securing elements 402' are illustrated in the present example, any number of securing elements 402' may be utilized as necessary or desired.

Although certain example methods and apparatus have been described herein, the scope of coverage of this patent is not limited thereto. While specific examples of the subject invention have been described in detail, it will be appreciated by those of ordinary skill in the art that various modifications and alternatives to those details could be developed in light of the overall teachings of this disclosure. It will therefore be appreciated that features described with respect to the various examples are not to be limited to any particular example but may be freely used across examples where applicable. Additionally, it will be appreciated that the size, shape, arrangement, and/or number of components illustrated and described can be changed as necessary to meet a given need. Accordingly, this patent covers all methods, apparatus, and articles of manufacture fairly falling within the scope of the appended claims either literally or under the doctrine of equivalents.

We claim:

1. A device for securing a LED light source module having a recess against a mounting surface comprising:

at least one continuous metallic path between the mounting surface and the LED light source module, the continuous metallic path having a feature positionable within the recess to prevent movement of the LED light source module relative to the mounting surface when the device secures the LED light source module against the mounting surface; and at least one electrical connector coupled to the continuous metallic path and electrically isolated from the continuous metallic path for electrically coupling an external conductor to an electrical contact pad of the LED light source module, the at least one electrical connector comprising a first end having a push-in type connector for receiving and securing the external conductor, and a second end formed at least partially from a resilient material to contact the electrical contact pad.

2. The device as recited in claim 1, wherein the at least one electrical connector comprises at least one additional push-in type connector electrically coupled to the first and second ends of the at least one electrical connector.

3. The device as recited in claim 1, wherein the at least one continuous metallic path further comprises at least one aperture for receiving one or more fasteners used to secure the device to the mounting surface.

4. The device as recited in claim 2, wherein the one or more metal fasteners that secure the device to the mounting surface thermally couple the at least one continuous metal path to the mounting surface.

5. The device as recited in claim 1, wherein the at least one continuous metallic path further comprises a set of arms, at least one of which is deflectable for grasping an accessory attachable to the device.

6. The device as recited in claim 1, wherein the at least one continuous metallic path contacts a surface of the LED light source module opposite the mounting surface.

7. The device as recited in claim 6, wherein the at least one continuous metallic path contacts a surface of the one or more sources of LED light opposite the mounting surface with a single thickness of the at least one continuous metallic path.

8. The device as recited in claim 1, wherein the device further comprises at least one electrically insulating housing coupled to the at least one continuous metallic path, the at least one electrically insulating housing having disposed therein the at least one electrical connector.

* * * * *